US005746530A

United States Patent [19]

Oota

[11] Patent Number: 5,746,530

[45] Date of Patent: May 5, 1998

[54] MEDIUM CONTAINER AND ITS SPARE MEDIUM

[76] Inventor: Etsuji Oota, Manshon Suzuno 401, 2-10, Honcho 3-chome, Nakano-ku, Tokyo 164, Japan

[21] Appl. No.: 700,413

[22] PCT Filed: Feb. 27, 1995

[86] PCT No.: PCT/JP95/00292

§ 371 Date: Nov. 12, 1996

§ 102(e) Date: Nov. 12, 1996

[87] PCT Pub. No.: WO95/23747

PCT Pub. Date: Sep. 8, 1995

[30] Foreign Application Priority Data

| | | | |
|---|---|---|---|
| Mar. 1, 1994 | [JP] | Japan | 6-054430 |
| Apr. 15, 1994 | [JP] | Japan | 6-101492 |
| May 30, 1994 | [JP] | Japan | 6-137795 |
| Jun. 13, 1994 | [JP] | Japan | 6-153039 |
| Jul. 27, 1994 | [JP] | Japan | 6-193860 |

[51] Int. Cl.[6] ..... B43K 27/08

[52] U.S. Cl. ..... 401/88

[58] Field of Search ..... 401/49, 55, 69, 401/75, 77, 88

[56] References Cited

U.S. PATENT DOCUMENTS

| | | | |
|---|---|---|---|
| 2,429,328 | 10/1947 | Rault | 206/56 |
| 3,653,776 | 4/1972 | Geisel | 401/88 X |
| 3,913,595 | 10/1975 | Grisel | 401/88 X |
| 4,993,858 | 2/1991 | Mock | 401/88 X |
| 5,044,804 | 9/1991 | Chuang | 401/88 X |

FOREIGN PATENT DOCUMENTS

| | | | |
|---|---|---|---|
| 1162534 | 4/1955 | France . | |
| 55-43100 | 10/1980 | Japan . | |
| 56-27845 | 7/1981 | Japan . | |
| 56-40329 | 9/1981 | Japan . | |
| 60-41846 | 3/1985 | Japan . | |
| 60-41847 | 3/1985 | Japan . | |
| 271420 | 5/1990 | Japan . | |
| 238663 | 10/1990 | Japan . | |
| 346666 | 10/1991 | Japan . | |
| 46654 | 2/1992 | Japan . | |
| 46655 | 2/1992 | Japan . | |
| 551209 | 7/1993 | Japan . | |
| 867102 | 5/1961 | United Kingdom | 401/88 |

*Primary Examiner*—William E. Stoll
*Attorney, Agent, or Firm*—Lorusso & Loud

[57] ABSTRACT

A stick cosmetic container is constructed so that a medium holder is moved into or out of a casing by a driving mechanism. The medium holder has first and second holding members which can be moved relative to each other. The two holding members may be moved in one axial direction relative to each other so that the stick cosmetic is forced forward from one of the holding members. A stopper is provided in association with the two holding members so as to directly restrict the beginning and/or the continuation of the relative movement of the two holding members in the one axial direction.

15 Claims, 25 Drawing Sheets

FIG. 3(A)
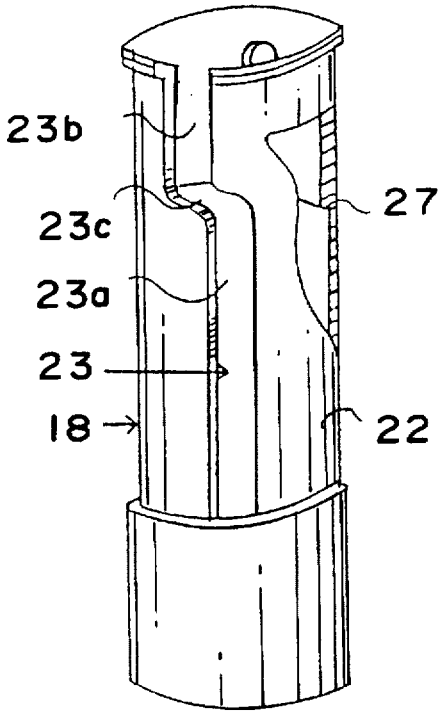
FIG. 3(B)
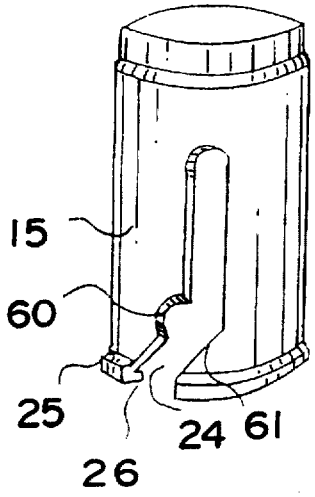
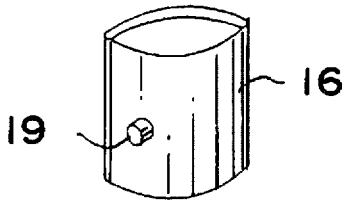
FIG. 3(C)

FIG. 4(A)
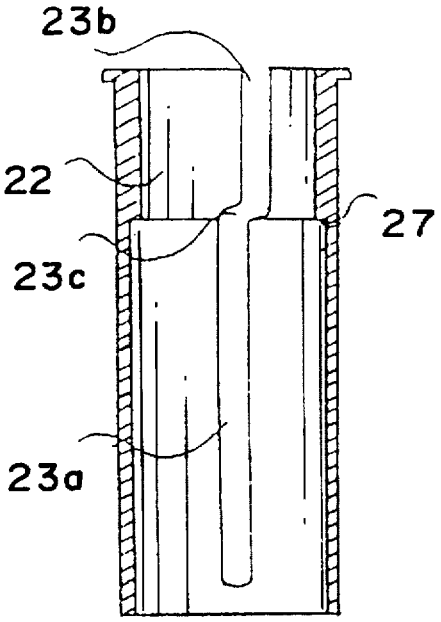
FIG. 4(D)
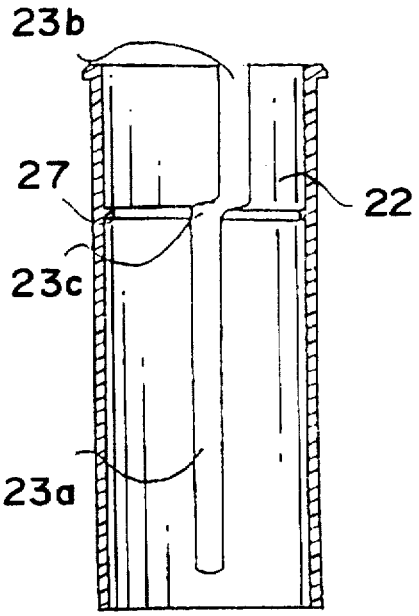
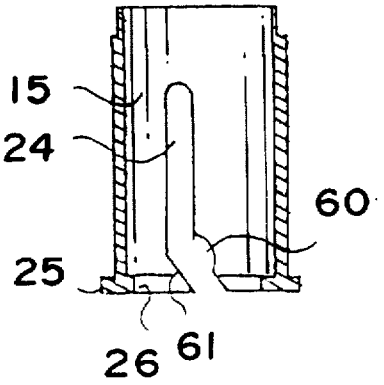
FIG. 4(B)
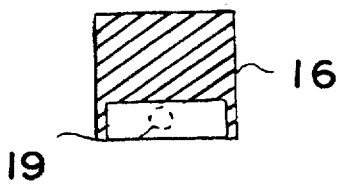
FIG. 4(C)

FIG. 5(A)
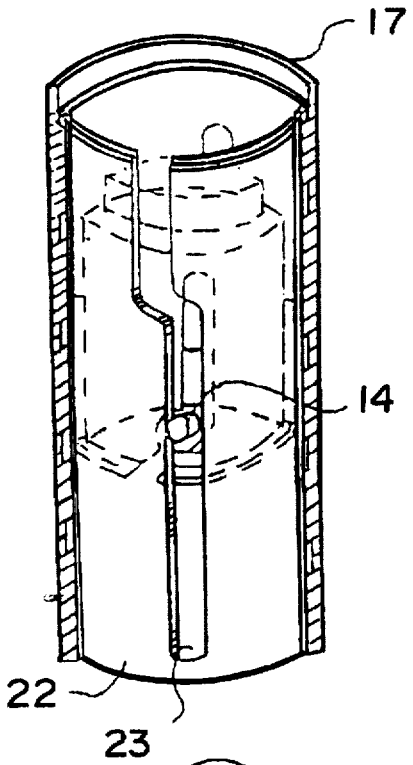
FIG. 5(B)
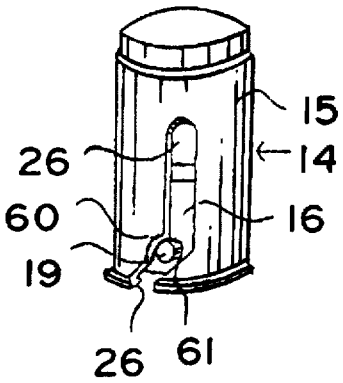
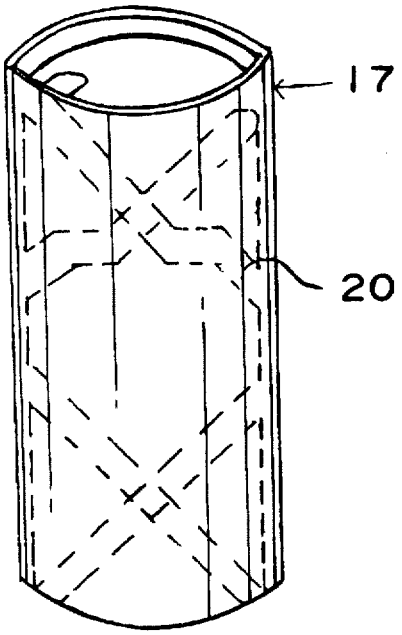
FIG. 5(C)
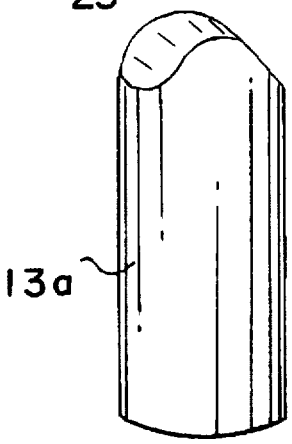
FIG. 5(D)

FIG. 6(A)
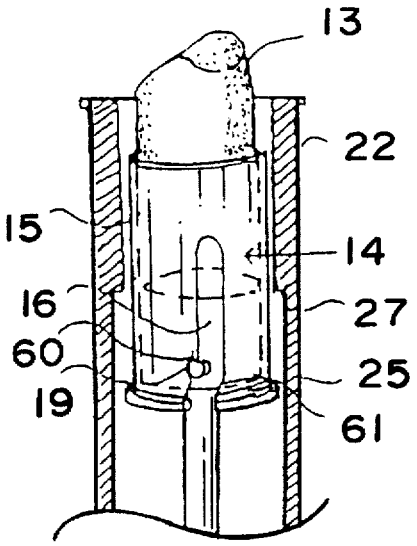
FIG. 6(B)
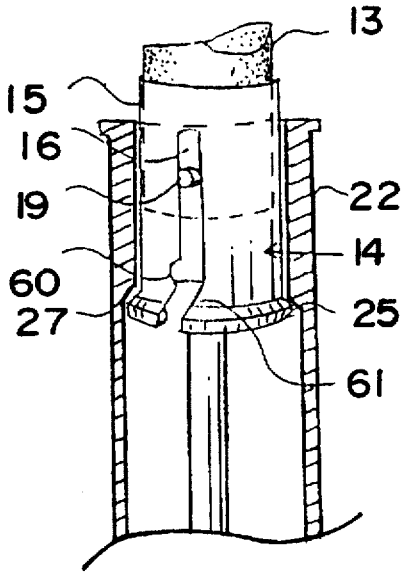
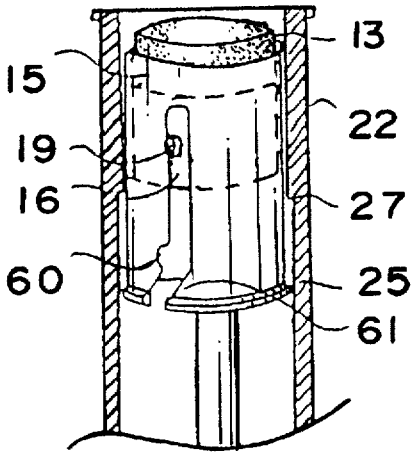
FIG. 6(C)
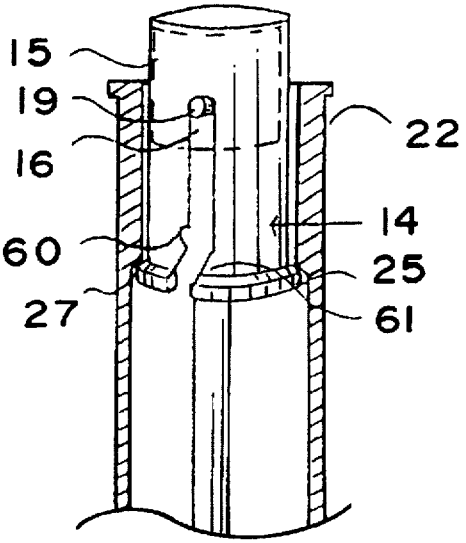
FIG. 6(D)

FIG. 7(A)
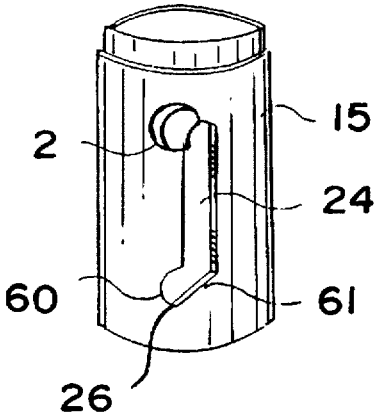
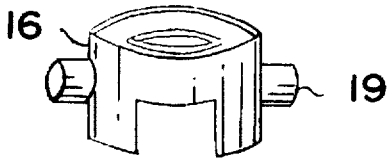
FIG. 7(B)
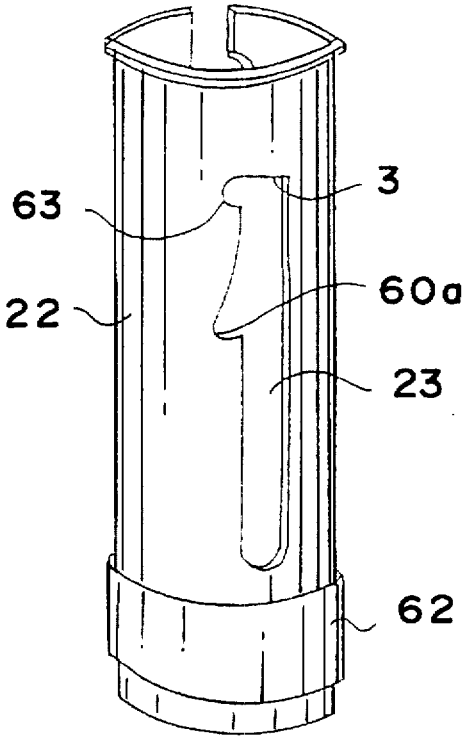
FIG. 7(C)
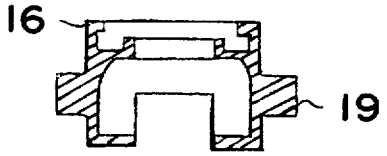
FIG. 7(D)

FIG. 10(A)
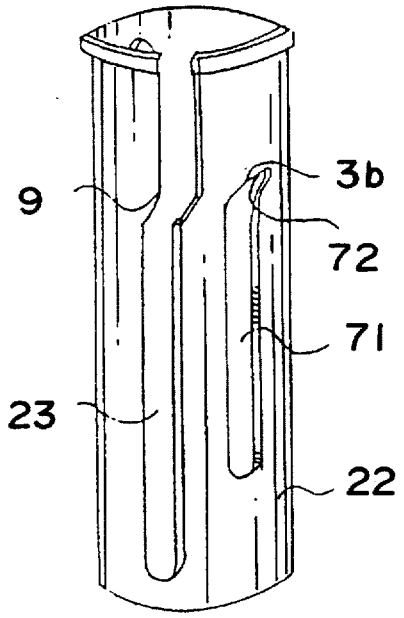
FIG. 10(B)
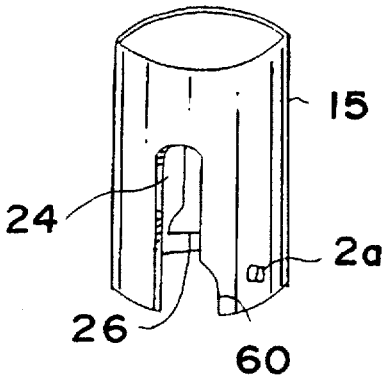
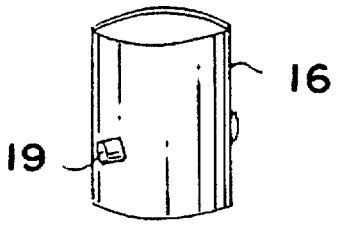
FIG. 10(C)

FIG. 14(A)
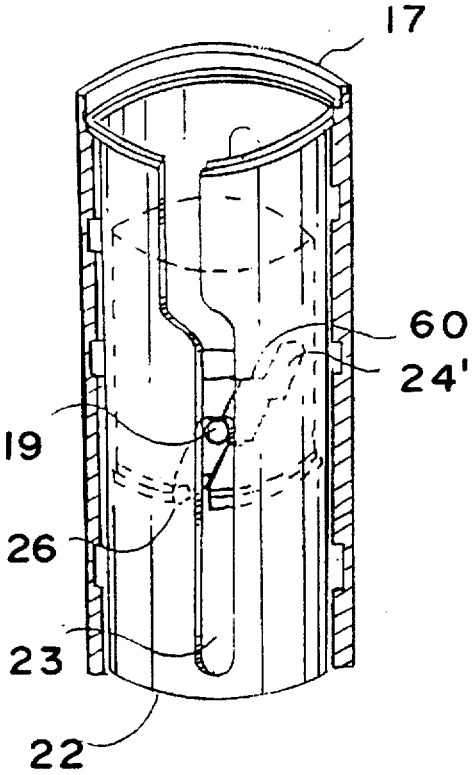
FIG. 14(B)
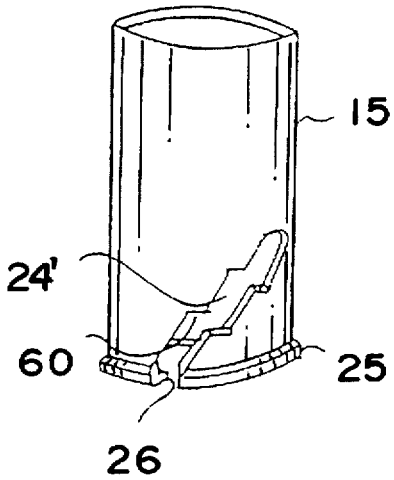
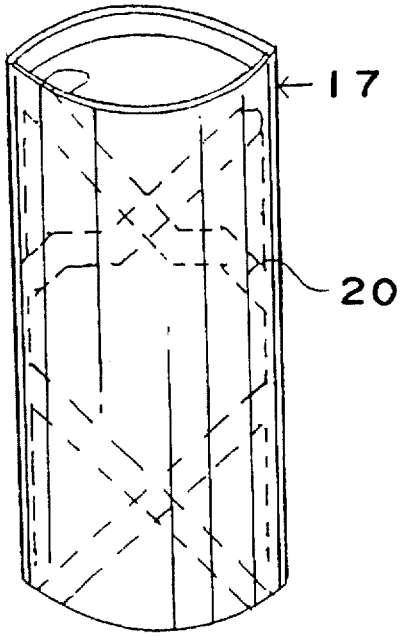
FIG. 14(C)

FIG. 15(A)
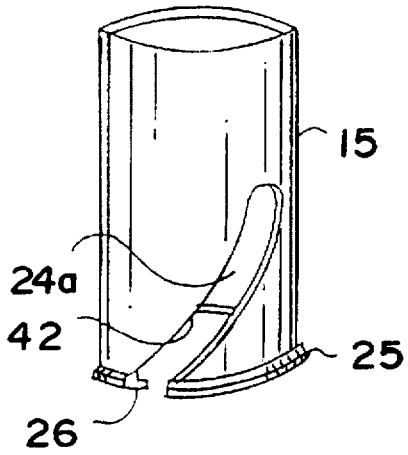
FIG. 15(B)
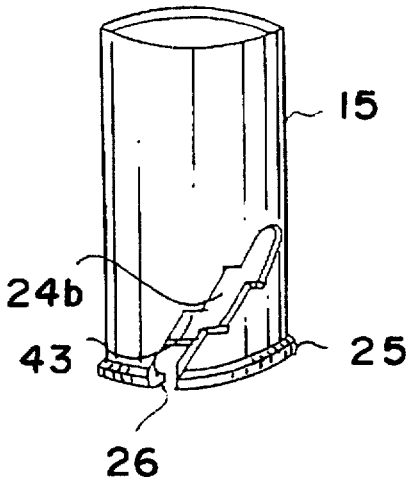
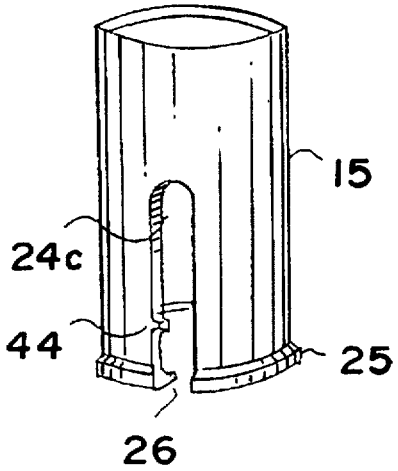
FIG. 15(C)
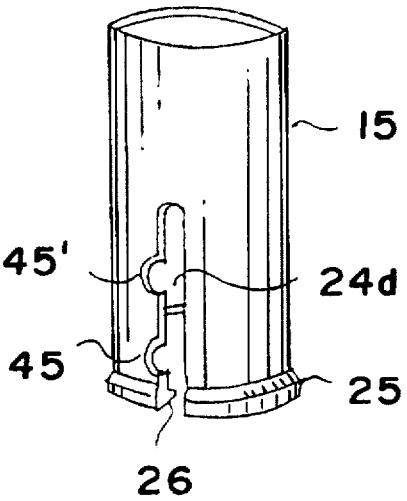
FIG. 15(D)

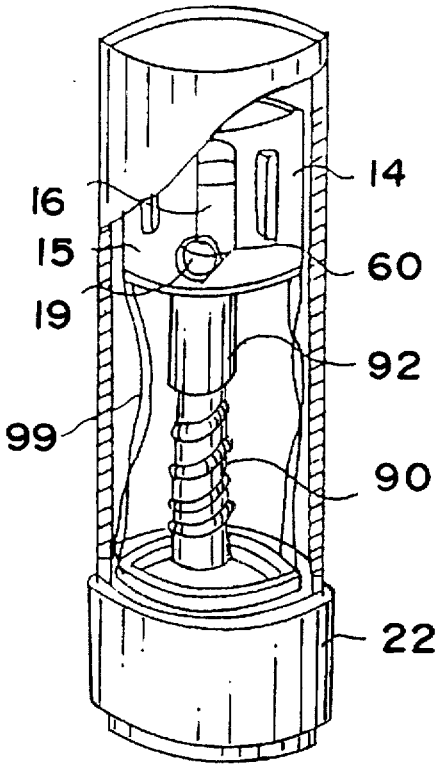
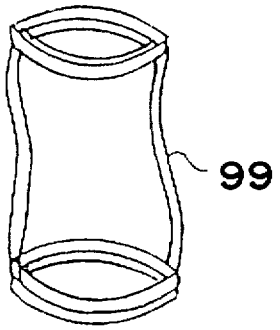
FIG. 22(B)
FIG. 22(A)

FIG. 23(A)
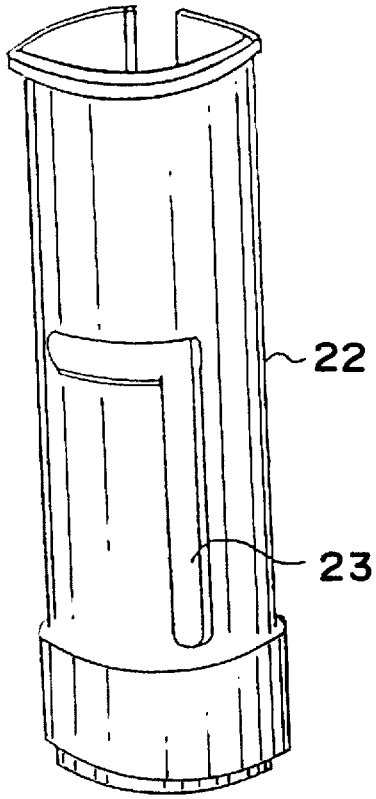
FIG. 23(B)
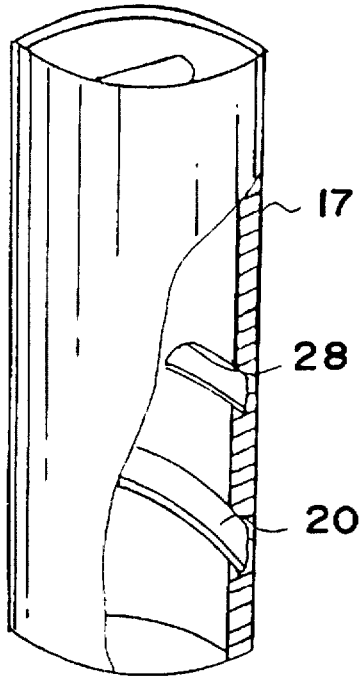
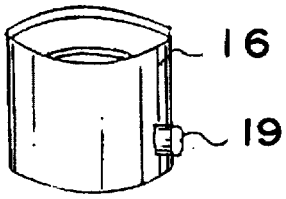
FIG. 23(C)
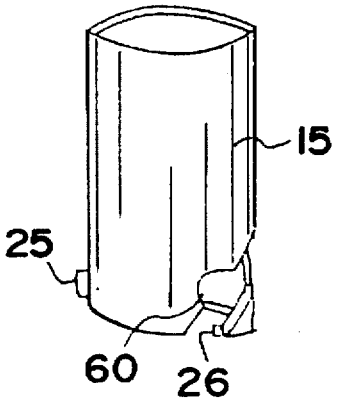
FIG. 23(D)

MEDIUM CONTAINER AND ITS SPARE MEDIUM

TECHNICAL FIELD

This invention relates to a container for a stick applicator and its spare and, particularly, to a lipstick container constructed so that a stick holding member may be moved axially of a casing by a driving means.

BACKGROUND ART

A conventional lipstick container now commercially available has a single cup-like holding member for accepting a lipstick, which is moved into or out from a casing body. Such a lipstick container is inconvenient in that the lipstick cannot be applied directly on the lips when it becomes short. It is possible but troublesome to remove the remaining lipstick from the bottom of the cup-like holding member by using a fingertip or a brush. Thus, more than a small amount of the lipstick is wasted.

A lipstick container having double holding members has been suggested, in which the remained lipstick can be forced forward by means of relative movement between the two holding members.

However, in this double constructed lipstick container, the two holding members go through unnecessary relative movement, resulting in a problem termed "falling down".

On the other hand, a container disclosed in Japanese Utility Model Laid-Open Nos. 60-41846 and 60-41847 has two members respectively driven so that the two members are prevented from moving relative to each other unnecessarily. However, in this container, once the lipstick is forced forward by mistake or mischief, it is hard to retract it. So when the lipstick is forced forward excessively, it must be returned by the fingers.

On that account, in spite of the fact that a majority of ladies are willing to use a lipstick container in which the lipstick can be completely used, it remains to be commercialized.

It is an object of this invention to provide a stick applicator which prevents the "falling down" effect, which is sufficiently reliable to be commercialized, and which is easy to use.

DESCRIPTION OF THE INVENTION

The stick applicator container of the invention includes a stick holding means mounted within and axially movable relative to a casing by means of a driving means. The holding means includes first and second holding members which can be moved relative to each other, the two holding members moving on a common axis relative to each other so that the stick applicator is forced forward relative to one of the holding members. A stopper is provided in the casing in association with the two holding members so as to directly restrict the beginning and/or the continuation of the relative axial movement of the two holding members.

Another aspect of the invention is provision of a spare stick applicator for mounting in the medium container as a refill.

In a preferred embodiment one of the medium holding members is not deformable in normal use but is deformable when a certain level of force is exerted. A deforming means partially engages and consequently deforms the one holding member on arriving at a predetermined position in the casing. Thus, the one holding member is first moved relative to the casing in a non-deformed condition and is subsequently deformed by engagement with the deforming means so that the stick applicator is forced further forward, moving relative to the one holding member for more accessibility. Preferably, a stopper is provided for restricting the beginning and/or the extent of the deformation of the holding member in such a manner that unless the stopper is unlocked the stick holding means cannot be further deformed.

BRIEF DESCRIPTION OF THE DRAWINGS

FIG. 3(A) is a perspective view showing the cylindrical member forming the casing body of FIG. 1; FIG. 3(B) is a perspective view of a following holding member; and FIG. 3(C) is a perspective view of a driven holding member.

FIG. 4(A), FIG. 4(B) FIG. 4(C) and FIG. 4(D) are cross-sectional views corresponding, respectively, to FIGS. 3(A), 3(B) and 3(C).

FIG. 5(A) is a perspective view showing the cylindrical member of FIG. 1 with the lipstick holding members mounted therein; FIG. 5(B) is a perspective view of the following holding member with the driven hold member assembled therein; FIG. 5(C) is a perspective view of the cylindrical member; and FIG. 5(D) is a perspective view of a spare lipstick.

FIGS. 6(A)–(D) are a series of a successive perspective views illustrating the operation of the lipstick container of FIG. 1.

FIG. 7(A) is a perspective view of a second embodiment of the driven holding member; FIG. 7(B) is a perspective view of the cylindrical member of the second embodiment; FIG. 7(C) is a perspective view of the following holding member of the second embodiment; and FIG. 7(D) is a sectional view of the driven holding member of the second embodiment.

FIGS. 10(A), 10(B) and 10(C) show components of a third embodiment, i.e. 10(A) shows the cylindrical member, 10(B) shows the following holding member, and 10(C) shows the driven holding member.

FIGS. 14(A), 14(B) and 14(C) are views showing components of a seventh embodiment, i.e. 14(A) shows the cylindrical member, 14(B) shows the driven holding member, and 14(C) shows the following holding member.

FIGS. 15(A), 15(B), 15(C) and 15(D) show various modified following holding members.

FIGS. 22(A) and 22(B) illustrate components of an embodiment of the interrupt means according to the invention.

FIG. 23 is a perspective view of another embodiment of the interrupt means.

DESCRIPTION OF THE PREFERRED EMBODIMENT

Embodiments according to the invention will now be described hereinafter with reference to the drawings.

Figure 2A:
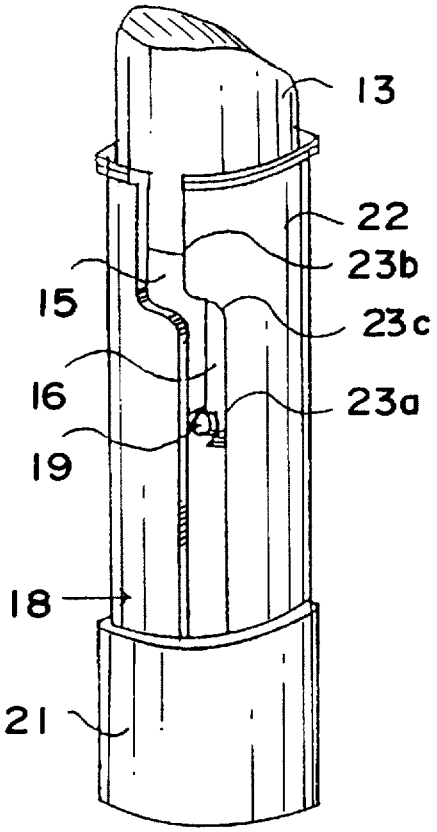
FIG. 2(A) is a perspective view of the casing body of FIG. 1(A) with the rotation member removed and FIG. 2(B) is a perspective view of the rotation member.
Figure 2B:
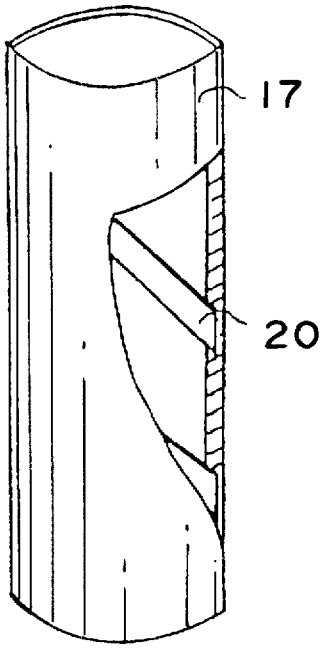

As shown in FIG. 2 the casing 18 includes a base 21 and a cylindrical member 22. The base 21 and the cylindrical member 22 are either an integral single body or are detachable. The cylindrical member 22 has two symmetrical elongated slots 23 generally extending along the axis. The slot 23 is curved at a crank portion 23*c* from which upper and lower straight portions 23*b*, 23*a* extend parallel to the axis.

Figures 1A, 1B:
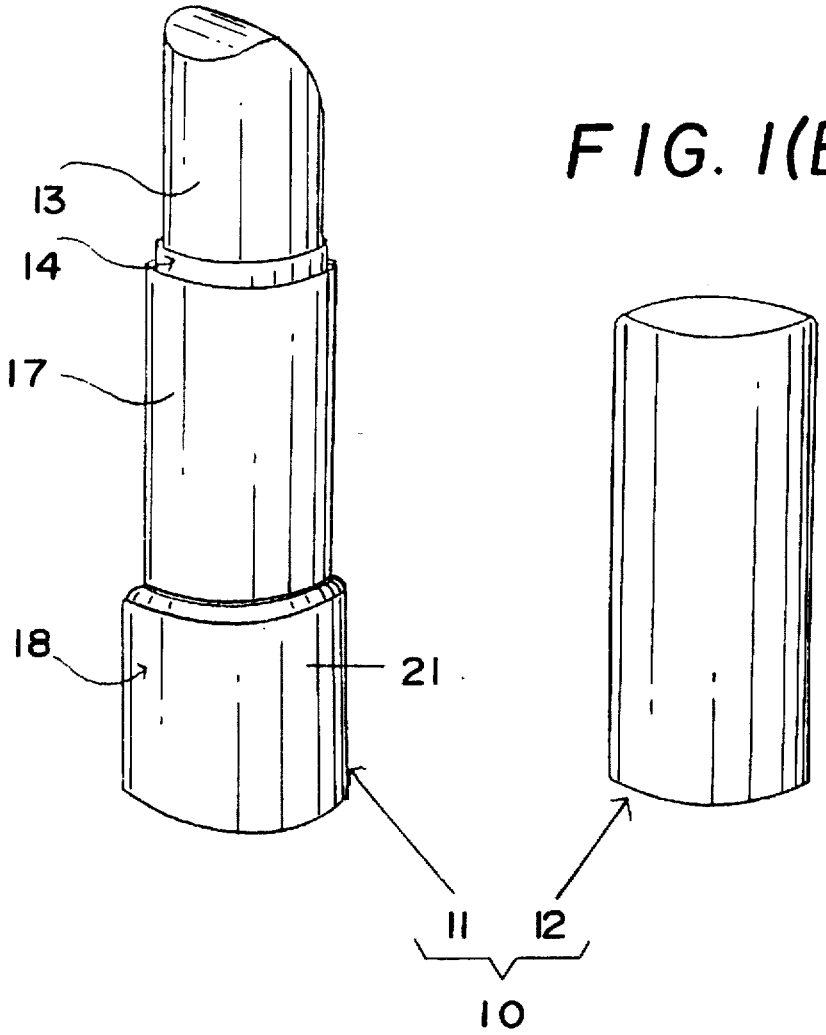
FIG. 1(A) is a perspective view of a lipstick container body of a first embodiment according to the invention and FIG. 1(B) is a perspective view of a cap for the container body.

Inside the cylindrical member 22 is mounted the lipstick holding member 14 for sliding movement along the slot 23. As shown in FIG. 2(A), 3(A), 3(B) and 3(C), lipstick holding member 14 (FIG. 1) is formed of a driven holding member 16 and a following holding member 15, i.e. a double construction. As seen in FIG. 2(A), the driven holding member 16 has a radial protrusion 19. The protrusion 19 is engaged with the slot 23 of the cylindrical member 22. The protrusion 19 and the slot 23 function as a cam and cam-follower, respectively.

The rotation member 17 is cylindrical in shape and has a diameter larger than that of the cylindrical member 22. It is fitted over the cylindrical member 22 in a manner rotatable relative thereto. The rotation member 17 has a spiral channel 20 formed on its interior surface in cooperation with the protrusion 19. The spiral channel 20 is interrupted by a portion corresponding to the crank portion 23*c* of the slot 23 of the cylindrical member 22, as shown in FIG. 5(C), which portion is parallel to the top and bottom faces of the rotation member 17.

The rotation member 17 is arranged around the cylindrical member 22 in such a manner that the protrusion 19 is engaged within the spiral channel 20. The spiral channel 20 and the protrusion 19 are related to each other as a cam and cam-follower.

When the rotation member 17 is turned relative to the cylindrical member 22, the driven holding member 16 is moved along the slot 23 by operation of the cam (channel 20) and cam-follower (protrusion 19). Thus the rotation member 17 and the cylindrical member 22 form the drive means. The driven holding member 16 is driven directly by the drive means, whereas the following holding member 15 is moved through the driven holding 16.

One of the slots 23 is open at its upper end whereas the other slot 23 is closed at its upper end, as shown in FIG. 3(A). Accordingly, the rotation member 17 can be easily assembled on the cylindrical member 22 only if its upper portion is of a reduced diameter. The cylindrical member 22 has an outwardly extending annular projection at its top end for preventing the rotation member 17 mounted thereon from becoming detached. The location of the annular projection determines the extent of motion of the rotation member 17 in one direction. The cylindrical member 22 has a relatively thick upper portion and a relatively thin lower portion, and a transition area (shoulder) 27 between the two portions which acts as one of the interrupt means. The engagement means can be formed as an annular projection 27, as shown in FIG. 4(D).

The following holding member 15 is generally cylindrical, as shown in FIGS. 3(A)–3(C) and 4(B), and its two ends are open. The outside diameter of holding member 15 is slightly smaller than the inner diameter of the cylindrical member 22 to allow the following holding member 15 to slide in the cylindrical member 22.

The following holding member 15 is provided with two slots 24 extending axially from the bottom to an intermediate portion thereof. The two slots 24 are symmetrical with respect to the axis and are engaged by respective protrusions 19 of the driven holding member 16. A concave cutout 60, serving as a stopper, is formed in the left bottom of the groove 24. Annular projections 25 and 26 are respectively formed outside and inside the bottom edge of the following holding member. The projection 26 is an anti-slip-off means, by which the driven holding member 16, inserted in the following setting member 15, is prevented from slipping out downward. The projection 25 also acts as the other interrupt means (relative movement means). The protrusion 19 of the driven holding means 16 and the concave cutout 60 of the following holding member 15 are also related to each other as cam and cam-follower.

The driven holding member 16 is generally cylindrical and has said two protrusions 19, as shown in FIGS. 3(C) and 4(C). The protrusions 19 are symmetrical relative to the axis. Each protrusion 19 engages one of the grooves 24 of the following holding member 15. The driven holding member 16 has a raised bottom and a planar top face, but it may be slightly sunken or provided with several small holes for reliably receiving a lipstick. The driven holding member 16 has an outside diameter which is slightly smaller than the inside diameter of the following holding member 15. Thus, the driven holding member 16 can slide in the following holding member 15.

As shown in FIG. 5(A), the lipstick holding member 14 is inserted in the cylindrical member 22 and the protrusion 19 is engaged within the slot 23. Over these members is fitted the rotation member 17 as shown in FIG. 5(A). In this state the two interrupt means 25, 27 are not engaged. In FIG. 5(B) the following holding member 15 and the driven holding member 16 are shown assembled with each other.

The length of the groove 24 of the following holding member 15 is set so that, when the driven holding member 16 is moved upward relative to the following holding member 15, and consequently the protrusion 19 engages the top of the groove 24, the top face of the driven holding member 16 is flush with the top upper end of the following holding member 15 or slightly retracted therefrom.

The lipstick can be conveniently mounted on the holding means 14 which is assembled in container body as shown in FIG. 5(A). At this stage the two holding members may be in the positions shown in FIG. 5(B), or with the driven holding member 16 moved upward. The lipstick may be inserted in a solid state as a spare lipstick 13*a*, or as a flowable liquid poured at raised temperature. In the latter case, it is convenient that the driven holding member 16 has a central opening formed in its bottom through which the flowable lipstick may be poured. In either case, the two holding members 15, 16 are assembled as shown in FIG. 5(B) when a lipstick is introduced. In this condition, not a small amount of the lipstick enters inside the following holding member 15.

The operation of the lipstick container 10 of this embodiment is hereinafter described with reference to FIG. 6(A)–(D). The rotation directions are defined as follows for convenience. The direction of rotation which serves to move the lipstick forward is defined as the advance direction, whereas backward is the reverse direction. And the direction in which the lipstick moves forward is defined as the upward direction, whereas retraction is the downward direction.

The lipstick is retracted into or extended out from the casing 18 by turning the rotation member 17 in the same manner as the conventional lipstick container. The driven holding member 16 and the following holding member 15 are moved together and never become detached due to the effects of the stopper (60) and the anti-slip-off means 26. The stopper prevents detachment upon movement in the forward direction, whereas the anti-slip-off means 26 prevents detachment upon movement in the other direction. The frictional force of the adhesion of the lipstick between the two holding members 15, 16, also contributes somewhat to preventing slip-off. Slip-off in the other direction can be prevented in connection to the forced forward movement of the lipstick described below so that the anti slip-off means 26 can be omitted.

In use, the protrusion 19 of the driven setting member is moved along the lower portion 23*a* of the slot 23. When the protrusion 19 comes to the top of the lower portion 23*a* of the slot 23, the two interrupt means, or the arc-shaped projection 25 of the following holding member 15 and the shoulder portion 27 of the cylindrical member 22, are just before becoming engaged.

When the lipstick becomes shorter, the rotation member 17 is rotated further in the advance direction so as to move the two holding members 15, 16 upward until the two interrupt means 25, 27 come into contact with each other. At the engaging position of the two interrupt means 25, 27, movement of the following holding member 15 is interrupted. The following holding member 15 cannot move upward past the point of engagement of the interrupt means. At this point the protrusion 19 of the driven holding member 16 is located in the circumferentially extending leg portion of the spiral channel 20, i.e. crank portion 23*c*.

Then, as the rotation member 17 is turned further in the advance direction so as to move the driven holding member 16 further upward, the two holding members 15, 16 separate in that 16 moves axially relative to member 15 and, consequently, the lipstick is forced forward.

However, in this embodiment, the lipstick cannot be forced forward unless the auxiliary stopper and the stopper are unlocked. The stopper directly restricts the relative movement between the two holding members 15, 16, whereas the auxiliary stopper restricts relative movement indirectly. The auxiliary stopper merely assists the stopper, so that it can be omitted.

The auxiliary stopper will now be described. When the two interrupt means 25, 26 are engaged with each other, the protrusion 19 of the driven holding member 16 is located at the entrance of the crank portion 23*c*. When the rotation member 17 is rotated further in the advance direction, the two holding members 15, 16 are immediately rotated a little in the advance direction (relative to the cylindrical member 22), and the protrusion 19 of the driven holding member is rotated along crank portion 23*c* of the slot 23 in the advance direction.

An opposing force is exerted during this rotation so that the rotation member 17, must be turned with a larger force than previously. This opposing force acts as the auxiliary stopper. The opposing force is caused by the interaction between the protrusion 19 of the driven setting member 16, crank portion 23*c* and spiral channel 20 both engaged with the former. So the opposing force can be increased by narrowing the crank portion 23*c* of the cylindrical portion 22 or the corresponding portion of the spiral channel 20, misaligning one of them or so forth. In other words, by adjusting the motion play in the drive means the force of the auxiliary stopper can be changed.

As described before, in the first embodiment, the opposing force created by the crank portion acts as the auxiliary stopper which indirectly restricts the relative movement between the two holding members. On the other hand, the stopper directly restricts the relative movement of the two holding members, and is provided between the two holding members 15, 16.

Next the stopper will be explained. In the first embodiment the stopper is a concave cut-out 60 formed on the left side of the groove 24 of the following holding member 15 which cooperates with the protrusion 19 of the driven holding member 16. Thus, the protrusion 19 behaves as one of the stopper members, as well as a drive member engaged by the spiral channel of the rotation member 17.

Where the protrusion 19 of the driven setting member 16 comes to the outlet of the crank portion 23*c*, the auxiliary stopper is almost unlocked. But the relative movement of the two setting members 15, 16, or the forward forcing of the lipstick, is restricted by the stopper, i.e. the driven holding member 16 is restricted from moving in the upward direction by the engagement of the protrusion 19 with the concave cut-out portion 60. Thus, the turning force required to move the protrusion 19 along lower straight portion 23*a* will not be sufficient to turn the rotation member 17 further in the advancing direction and, consequently, the driven holding member can not be moved upward.

The rotation member 17 must be rotated in the advancing direction with a larger force than previously required in order to unlock the stopper. The protrusion 19 is strongly forced upward and, consequently, the following member 15 is forced by the protrusion 19 in such a manner that the two members are disengaged. As described above, the stopper is unlocked by means of the relative movement between the two holding members. At this stage the relative movement includes two vectors, i.e. a relative rotational movement and a relative axial movement. When the stopper is unlocked, the lipstick is slightly forced forward.

The upper right portion of the stopper concave cut-out 60 may be deformed when the stopper is unlocked. As described below, the stopper can be constructed so as to positively make use of such a deformation.

In the first embodiment, first the auxiliary stopper is unlocked, and next the stopper is unlocked. The auxiliary stopper and the stopper can be unlocked successively if the rotation member 17 is continuously turned with a larger force than used prior to engagement of the stopper. The forces required for unlocking the two stoppers are respectively defined in an arbitrary manner. Once the auxiliary stopper and the stopper are unlocked, the two holding members 15, 16 can be relatively moved, with movement of driven holding member 16 in the axial upward direction forcing the lipstick 13 forward from the following holding member 15.

The length of the lipstick 13 extending from the casing can be adjusted by the number of degrees the rotation member 17 is turned by the operator. The force required for forcing the lipstick forward can be increased by narrowing the slot portion **23*b* of the cylindrical member 22 or the slot 24 of the following holding member 15, or by increasing the upward slant of the slot portion 23*b*** further toward the right. Excessive extension of the lipstick forward can thereby be prevented.

After the lipstick 13 is used, the rotation member 17 is turned in the reverse direction. As the lipstick is retracted, the stopper does not act. During the retraction, first the two holding members 15, 16 are moved downward together, or retain the same relative positioning due to the stickiness of the lipstick or the frictional force between the two holding members 15, 16. FIG. 6(C) shows the state wherein the lipstick 13 is somewhat withdrawn into the casing.

The rotation member 17 is further turned in the reverse direction until the bottom of the following holding member 15 engages with the bottom of the cylindrical member 22, so that the following member 15 is prevented from moving further downward. Then the two holding members 15, 16 are moved relative to each other in the direction reverse to the prior relative movement. Finally the protrusion 19 of the driven holding member 16 is moved along the sloped surface 61, which defines the lower right side of the slot 24 of the following setting member 15, until the two holding members 15, 16 come into the same relative positioning as they were previously. In this last step, turning the rotation member 17 requires a heavier force. However, the two holding members 15, 16 may be stopped with the relative positioning shown in FIG. 6(C) as in the process of extending the lipstick. The two interrupt members 25, 27 are disengaged from each other as the holding members 15, 16 start to move downward.

Next, forcing of the lipstick forward can be performed in the same manner as described before. As described before, some of the shortened lipstick 13 can be forced forward from the following holding member 15, so that almost all the lipstick 13 can be used as shown in FIG. 6(D). The handling of the rotation member 17 is essentially the same as the conventional lipstick container except that the resistance forces of the auxiliary stopper and the stopper must be overcome, and complicated handling is not necessary.

Next a second embodiment according to the invention will be described with reference to FIGS. 7(A)–7(D) and 8(A)–8(C).

In this embodiment the two interrupt means are constructed as a projection 2 formed at the upper end of the slot 24 of the following holding member 15 and an upper edge 3 of the slot 23 of the cylindrical member 22 engageable by projection 2, as shown in FIG. 7(A). The same stopper concave notch 60, as in the first embodiment, is formed on the groove 24 of the following holding member 15. A concave notch **60*a*, serving as an auxiliary stopper, is formed in the middle left side of the slot 23 of the cylindrical member 22, and a notch 63 is formed at the upper end thereof, as shown in FIG. 7(B). In this embodiment the two slots 24 are symmetrical but one of them is closed at its lower end so as to form the anti slip-off means 26. The anti slip-off means 26 defines a lower edge of the stopper concave portion 60. The driven holding member 16 is so formed that the lipstick can be easily poured therein, as shown in FIGS. 7**(C, D).

The operation of the second embodiment will be described hereinafter with reference to FIGS. 8(A)–8(C).

Figures 8A, 8B, 8C:
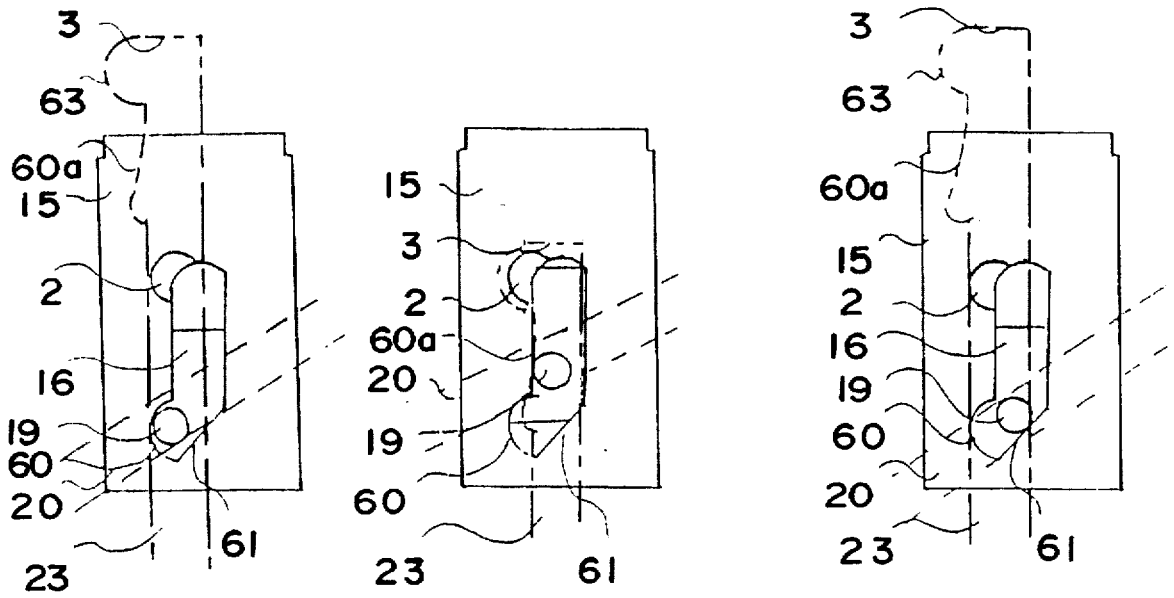
FIGS. 8(A), 8(B) and 8(C) are a series of perspective views illustrating the operation of the second embodiment shown in FIGS. 7(A)–7(D).

FIG. 8(A) shows the condition before the projection 25 engages the upper edge 3 of the slot 23. The projection 2 of the following holding member 15 is moved upward along the left side of the slot 23 of the cylindrical member 22. The slot 24 of the following holding member 15 and the slot 23 of the cylindrical member 22 are somewhat offset. Accordingly, the protrusion 19 of the driven setting member 16 is blocked by the right side of the slot 23 so that it cannot easily move out of the stopper concave notch 60 of the following holding member 16. Thus, the two holding members 15, 16 are secured against slipping-off.

In order to force forward the lipstick, first the two holding members 15, 16 are moved upward until the two interrupt means 2, 3 are engaged with each other, whereby the following holding member 15 is restricted from further movement upward. The two holding members 15, 16 are rotated in the advancing direction by means of the driving force, which is exerted in an upward slanted and advancing direction on the protrusion 19 of the following holding member 15 by the spiral channel 20. Then the interrupt member ("projection") 2 is moved into the concave notch 63 of the left side of the interrupt member 3, whereby the protrusion 19 of the driven holding member 16 engages within the concave portion **60*a* of the slot 23**.

At the end of the rotation, the slot of the following holding member 15 and the slot 23 of the cylindrical member 22 are almost aligned with each other so that the stopper can be unlocked. In other words, the stopper is unlocked when the protrusion 19 is moved in a upward slanted and reverse rotation direction (right upward in the figure).

When the driven holding member 16 is moved upward, its protrusion 19 receives a driving force in an upward slanted advance rotation direction by the bottom edge of the spiral channel 20. The protrusion 19, requires a greater force for this upward slanted advance rotation direction than that previously required to move the two holding members 15, 16 upward together. Further, when the two holding members are axially moved relative to each other, they must overcome the frictional force of the stickiness of the lipstick therebetween.

Following operations may be used for unlocking the stopper rather than simply turning the rotation member 17 with a heavy force. Specifically, the rotation member may be pulled upward while rotating the rotation member 17 slightly in the direction which is the reverse of that induced from the raising operation. These two operations can generally unlock the stopper easier than the simple rotating. The rotation member 17, has a moderate motion play in the axial direction. Such operations for unlocking the stopper can be applied to the first embodiment.

The force required to unlock the stopper can be adjusted by modifying the size and the configuration of the stopper concave portion 60 and, consequently, the depth of the engagement between the protrusion 19 and concave portion 60. In each case when the stopper is unlocked as shown in FIG. 8(B), the protrusion of the driven holding member 16 is moved out from the stopper concave portion 60 in an upward slanted and reverse rotation direction, pushed by the lower edge of the spiral channel 20 of the rotation member 17. The lipstick is thereby slightly forced forward.

Now the lipstick is forced slightly forward and the protrusion 19 of the driven holding member 16 engages at a point somewhat above the deepest portion of the auxiliary stopper concave 60*a*. When the rotation member 17 is further turned in the advance rotation direction, the driven holding member 16 is moved upward relative to the following holding member 15 (interrupted condition), whereby the lipstick can be extended to a desired length.

However when the lipstick is forced forward, the rotation member 17 must be turned in the direction of advance rotation to move the protrusion 19 along the slanted edge, to the left and upward. Accordingly, the relative movement of the two holding members 15, 16 is restricted indirectly by the auxiliary stopper so that the lipstick is prevented from being forced too far forward.

The effectiveness of the auxiliary stopper, or the force required for forcing the lipstick forward, can be adjusted by changing the angle of the left upward slanted edge of the concave notch 60*a*. Optionally, the angle of inclination of the left upward slanted edge may be changed at its midpoint.

On the other hand, when the lipstick is withdrawn into the container, the above-described procedures are reversed. The protrusion 19 of the driven holding member 16 receives a driving force directed in a diagonal downward and reverse rotation direction. First, the driven holding member 16 and the following holding member 15 are slightly rotated together in the reverse direction, whereby the projection 2 is moved out of the concave notch 63. Then the driven holding member 16 and the following holding member 15 are moved downward together. Due to the stickiness of the lipstick and the frictional force between the driven holding member 16 and the following holding member 15, they move together.

The driven holding member 16 and the following holding member 15 are moved further downward until the bottom edge of the following holding member 15 engages a collar 62 formed on the lower part of the cylindrical member 22. The following holding member 15 is restricted from moving further downward by this engagement with collar 62, so that only the driven holding member 16 is moved downward beyond that point. Finally, the protrusion 19 of the driven holding member 16 is moved back into the concave notch 60 via the lower slanted edge 61 (see FIG. 8 (C)) of the slot 24 of the following holding member 15, so that the two holding members 15, 16 are brought back into their retracted position. While the two holding members 15, 16 can be stopped short of the completely retracted position, the stopper is not engaged as the lipstick is retracted.

Figure 9A:
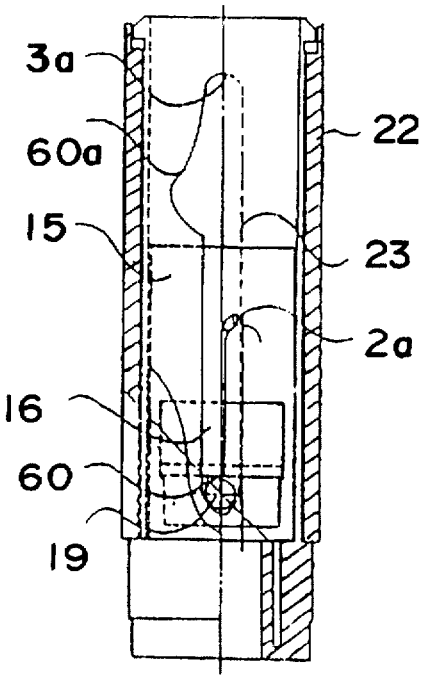
FIGS. 9(A) and 9(B) are perspective views of a modification of the embodiment of FIGS. 7(A)–7(D).
Figure 9B:
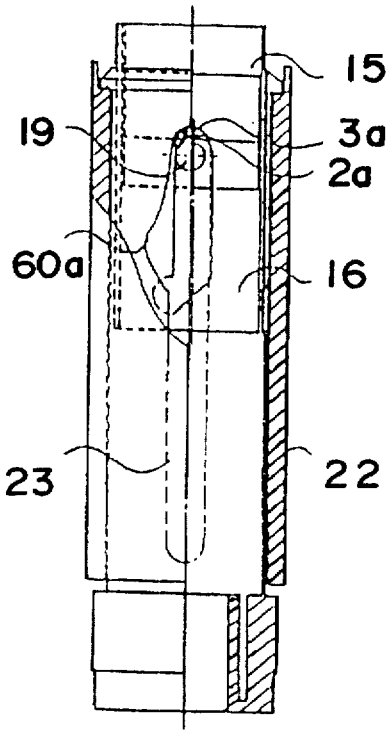

FIG. 9 shows a modification of the embodiment of FIG. 8. In this embodiment the upper concave notch 63 of the slot of the cylindrical member 22 is omitted. On that account, a small projection 2*a* is added.

Next a third embodiment of this invention will be described with reference to FIGS. 10(A)–10(C). In this embodiment the cylindrical member 22 is provided with the another slot 71 adjacent to the slot 23 as shown in FIG. 10(A). The slot 71 restricts the rotation of the following holding member 15. The slot 71 is provided with a concave notch 72 formed on the upper left edge thereof. The slot 23 for guiding the protrusion 19 of the driven holding member 16 is bent at a curved portion 9.

The concave notch 72 of the slot 71 and the curved portion 9 of the slot 23 are located at almost the same height. The circumferential width of the concave notch 72 is somewhat larger than that of the curved portion 60*a*. The curved portion 60*a* serves as the auxiliary stopper.

The following holding member 15 has a projection 2*a* which is engaged within the slot 71 of the cylindrical member 22. The projection 2*a* serves as the other interrupt means. The stopper concave portion 60 is formed on the right side of the slot 24 of the following holding member 15. The slot 24 located behind the figure is closed at its bottom edge which acts as the anti-slip-off means 26.

At first the two holding members 15, 16 are relatively positioned so that the protrusion 19 is located in the concave portion 60 and when the two holding members are assembled into the cylindrical member 22, the protrusion 19 of the driven holding member 16 becomes engaged within the left side of the slot 23. In this condition the two holding members are prevented from rotating relative to each other, and move vertically along the slot 23. Therefore the two holding members 15, 16 are prevented from coming apart.

Next the operation of the stopper in the third embodiment will be explained. When the lipstick becomes short, the rotation member 17 is turned in the advance rotation direction so that the two holding members 15, 16 are moved upward together. When the protrusion 19 of the driven holding member comes to the curved portion 9, the force required for turning becomes larger. Upon further turning of the rotation member the driven member 16 is moved along the curved portion 9 diagonally upward with reverse rotation relative to the cylindrical member 22. The following holding member 15 is moved with the driven holding member 16 by the driving force which is exerted on its curved portion 9 via the protrusion 19 in the diagonally upward and reverse rotation direction. The projection 25 of the following holding member 15 is moved within the concave notch 72 until it engages the upper edge 3*b* of the slot 71.

When the two interrupt means 2*a*, 3*b* become engaged with each other, the following holding member 15 is prevented from further upward movement. Thereby, the following holding member 15 is rotated in the reverse direction relative to the driven holding member 16 in such a manner that the stopper concave portion 60 is pushed by the protrusion 19 thus unlocking from the stopper. Thus, the stopper is unlocked by means of the relative movement between the two holding members 15, 16.

When the stopper is unlocked, the lipstick is forced slightly forward. The rotation member 17 is further turned so that the driven holding member 16 moves upward relative to the following holding member 15, whereby the lipstick is forced forward.

In this embodiment, the stopper and the auxiliary stopper are unlocked at substantially the same time in an operation requiring a larger driving force than the prior turning.

The stopper may also be constructed as a concave portion 60 formed on the right side of the groove 24 and a concave notch 72 formed on the left side of the slot 71. In this case, the left side of the slot 23 may be straight, but it preferably has a curved bend 9 serving as the auxiliary stopper in order to prevent the lipstick from being extended too far forward.

In the embodiment shown in FIG. 10, the cylindrical member 22 can be modified in its length and diameter in a comparatively easy manner. Moreover, the position where the lipstick begins to be extended can also be freely modified by repositioning the upper edge 3*b* of the slot 71.

Figure 11:
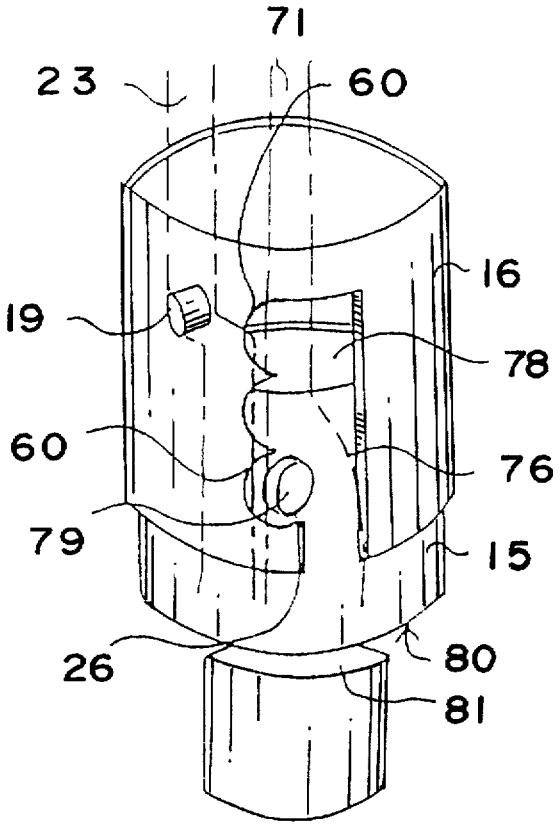
FIG. 11 is a perspective view of a fourth embodiment of the invention.

Next the fourth embodiment of the invention will be described with reference to FIG. 11. In this embodiment, the cylindrical member 22 is provided with a projection 81 in its bottom, the top face of which forms one of the interrupt means. The bottom face 80 of the following holding member 15 forms the other interrupt means. The following holding member 15 has a projection 79, while the driven holding member 16 has a slot 78 engaged by the projection 79. The groove 78 has three concave notches 60 as the stopper. The projection 79 is shown engaged within the lower concave notch 60. The cylindrical member 22 has another slot 71 adjacent to the slot 23. The slot 71 has a curved portion 76 which widens below the curved portion 76. The projection 79 is shown engaged within the slot 71.

In operation of this fourth embodiment first the rotation member is turned so that the protrusion 19 of the driven holding member 16 is moved along the upper portion **23*b* of slot 23** for use of the lipstick.

When the lipstick is short, the rotation member 17 is turned in the reverse direction, and the two rotation members 15, 16 are withdrawn together deep into the casing. When the protrusion 19 of the driven holding member 16 has passed through the crank portion **23*c*, the bottom 80 of the following holding member 16 engages the projection 81 so that the following holding member 16 is prevented from moving further downward. As the protrusion 19 passes through the crank portion 23*c*, it receives a force opposing rotation whereby the crank portion 23*c*** serves as the auxiliary stopper.

When the rotation member 17 is further turned in the reverse direction, so that the driven holding member 16 is moved downward, the lipstick is thereby forced forward from the driven holding member 16. However the driven holding member 16 is hardly moved downward because the projection 79 of the following holding member 15 is engaged into the lowest concave notch 60 of the stopper. Unless the stopper is unlocked, the lipstick cannot be forced forward.

Then the rotation member 17 is turned in the reverse direction with a larger force than previously so that the driven holding member 16 is forced downward. Accordingly, the following holding member 15 is rotated in the reverse rotation direction relative to the driven holding member 16 so that the projection 79 is forced out of the lowest concave notch 60 in such a manner that the projection 79 is pushed by the lowest concave notch 60. The following holding member 15 is thereby rotated in the reverse direction.

When the projection 79 is removed from the lowest concave notch 60 and the stopper is thereby unlocked, the lipstick is forced slightly forward from the driven holding member 16. The lipstick can be forced forward to a desired length by further turning of the rotation member 17 in the reverse direction.

Then the rotation member 17 is turned in the advance direction so that the driven holding member 16 is moved upward. The following holding member 15 is moved upward together with the driven holding member 16 due to the stickiness of the lipstick and a frictional force exerted therebetween so that the two interrupt means are removed immediately. When the two holding members 15, 16 are moved upward, the projection 79 is pushed by the curved portion 76 of the slot 71 of the cylindrical member 22 so that only the following holding member 15 is rotated in the advance direction. Accordingly, the projection 79 is engaged with the next concave notch 60 from which it can be removed only with difficulty. This engagement prevents the lipstick from slipping off. The interrupt means 81 can be provided with a spring to urge it upward. In this case, the projection 79 is reliably engaged with the concave notch 60.

The rotation member 17 is turned further in the direction of advance rotation, so that the two holding members 15, 16 are moved upward, whereby the lipstick is extended from the casing and is used. The lipstick can be forced forward next time in the same manner. In this embodiment, when the lipstick becomes short the lipstick is forced forward in the casing by the operation of retraction into the casing after use.

Next a fifth embodiment of the invention will be described with reference to FIG. 12. In this embodiment, the driven holding member 16 is provided with a resilient deformable member 74, the radial resilient deformation of which is utilized for unlocking the stopper.

Figures 12A, 12B, 12C:
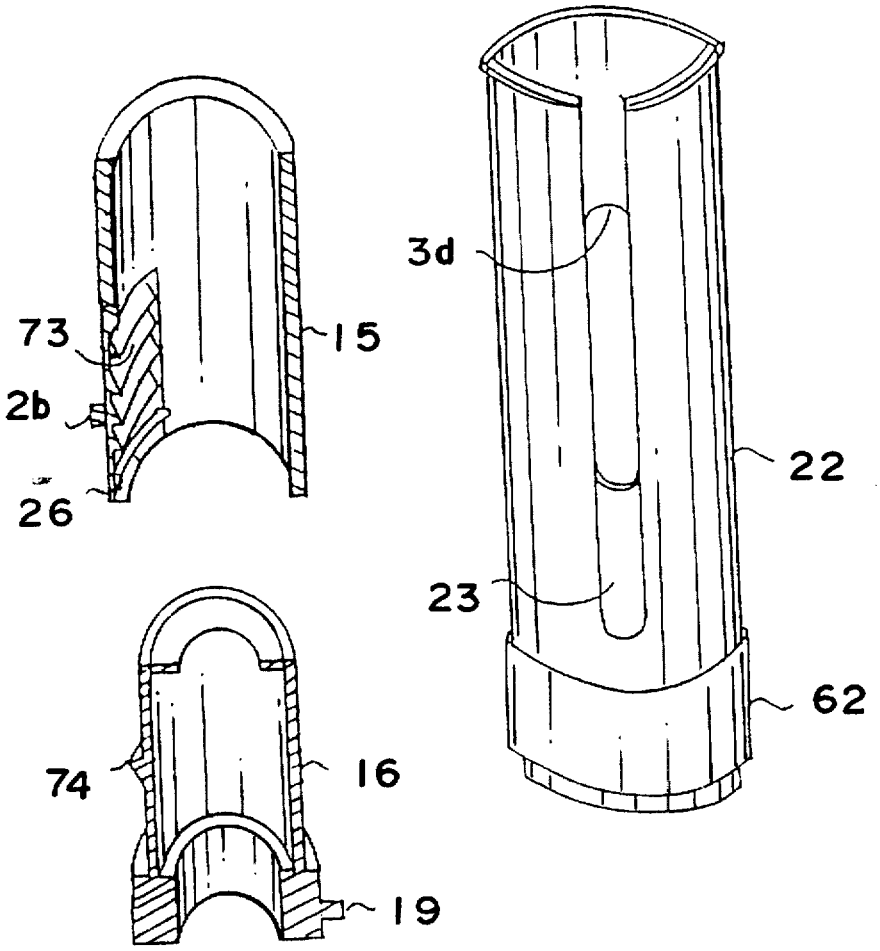
FIGS. 12(A), 12(B) and 12(C) show components of a fifth embodiment of the invention, i.e. 12(A) shows the cylindrical member, 12(B) shows the following holding member, 12(C) shows the driven holding member.

As shown in FIG. 12(C), the driven holding member 16 carries the resilient deformable member 74. Whereas the following holding member 15 has step portions 82 which are engaged by the deformable member 74, as shown in FIG. 12(A). The engagement between the deformable member 74 and one of the step portions 73 can not be disengaged in normal use. Accordingly the lipstick has no possibility of slipping out. The deformable member 74 may be formed as a leg projecting from the lower edge of the driven holding member 16, in which case the member is easily resiliently deformed. The interrupt means in this embodiment is the combination of the upper edge **3*d* of the slot 23 and the projection 2*b* of the following holding member 15**.

In operation of this embodiment, the two holding members 15, 16 are first moved upward until the following holding member 15 is stopped by of the interrupt means **3*d*. Next the rotation member 17 is turned in the direction of advance rotation by a larger force than required prior to engagement of interrupt means 3*d*. Accordingly the deformable member 74 is resiliently and radially deformed, and rises along the step portions 73 step by step in a clicking manner. Thus, the driven holding member 16 is moved upward relative to the following holding member 15 so that the lipstick is forced forward stepwise between step portions 73**.

On the other hand, when the lipstick is retracted, the rotation member is turned in the direction of reverse rotation, a larger force being required after the bottom of the following holding member 15 reaches the bottom of the casing (cylindrical member), whereby the two holding members can be returned to their prior relationship. However it is not necessary to do so. The forces required for extending and retracting can be adjusted as desired by changing the angles of slant of the upper and the lower surfaces of the deformable member 74 and the step portions 73.

Figure 13A:
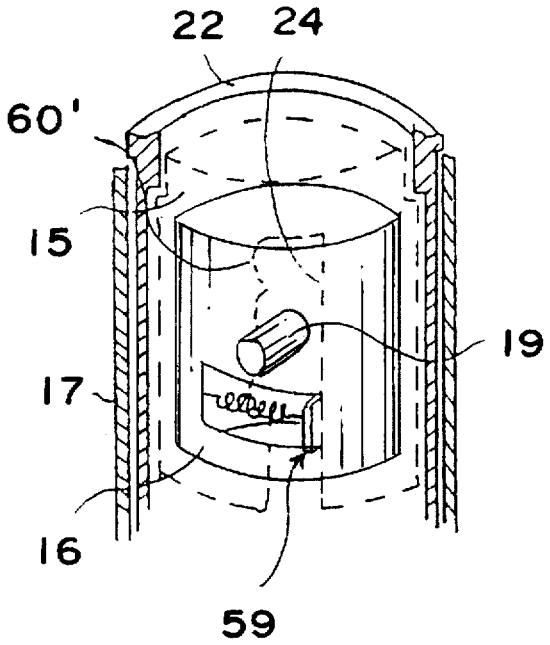
FIGS. 13(A) and 13(B) are schematic views of a sixth embodiment of the invention.
Figure 13B:
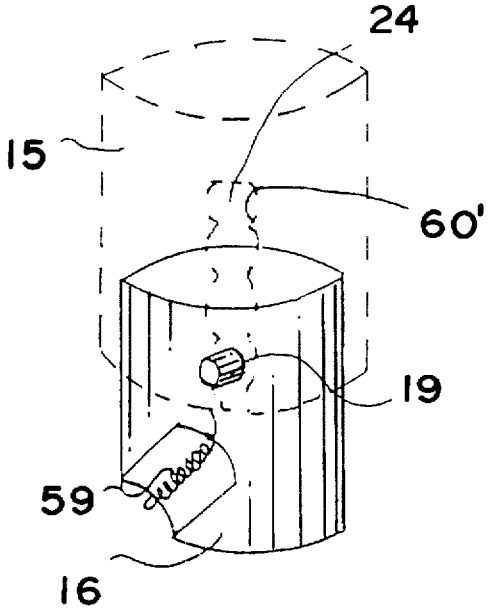

A sixth embodiment of this invention will be described with reference to FIG. 13. In this sixth embodiment biasing means 59 is interposed between the two holding members. The biasing means 59 urges relative rotation between the two holding members in such a manner that the protrusion 19 of the driven holding member 16 is biased into one of the series of concave notches or stopper portions 60'. The holding strength of the stopper can be adjusted by changing the depth of the stopper portions 60' and/or the tension of the biasing means 59. The biasing means 59 can be a spring or a rubber member. The other components may be substantially the same as those of the first or the third embodiment. The lipstick is forced forward stepwise in this embodiment.

FIG. 14 shows a seventh embodiment of the invention. Other than the following holding member 15, the components are similar to the first embodiment. The following holding member 15 has a step-shaped slot 24' extending axially and to the right from the lower edge, as shown in FIG. 14(B). Thus, the slot 24' is formed of a series alternating axially extending and circumferentially extending edge portions. The upper circumferential edge portions serve as the stopper means in this embodiment. As the lipstick is forced forward, this stopper means acts twice to impede further forward movement of the lipstick. When the protrusion 19 is moved along the edge portions of slot 24' which extend axially to the right, forcing forward the lipstick, the following holding member 15 is rotated in the direction of advance rotation relative to the cylindrical member 22. Thus, in the case of the stepped slot 24', the lipstick can be forced forward from the following holding member in a manner corresponding to the shape of the slot. Operations other than the above are almost same as those for the first embodiment.

Figure 16A:
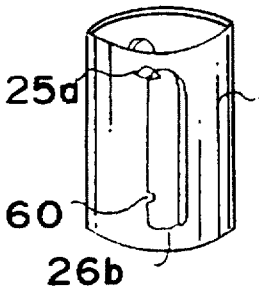
FIGS. 16(A)–16(G) show further modifications of the following holding member.
Figure 16B:
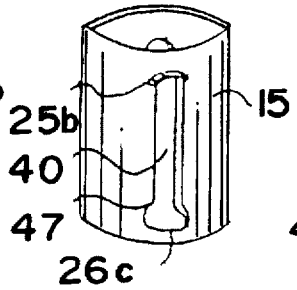
Figure 16C:
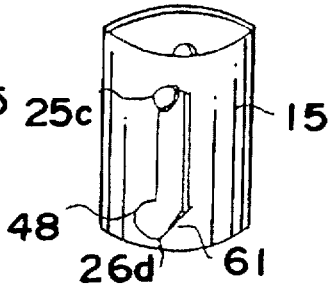
Figure 16D:
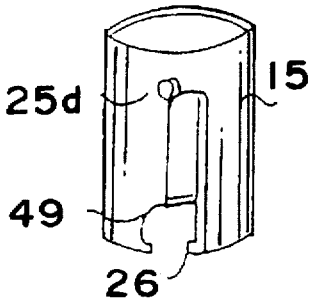
Figure 16E:
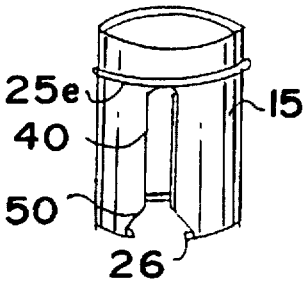
Figure 16F:
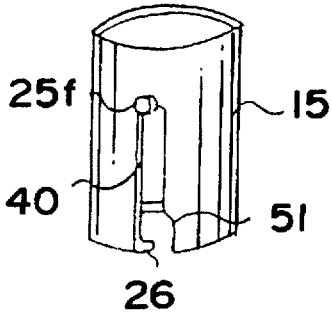
Figure 16G:
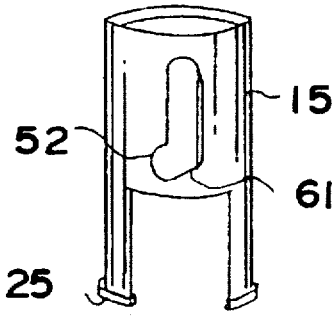

FIGS. 15(A)–15(D) and FIGS. 16(A)–16(G) are views showing modified embodiments of the following holding member. In embodiments with a plurality of stopper notches, as shown in FIGS. 15(B) and 15(D), the stopper means acts plural times. In embodiments wherein the slot becomes narrower beyond its midpoint as shown in FIG. 16(B), 16(E), 16(F), the auxiliary stopper is formed by the narrow portion 40, which requires a heavier force for forcing the lipstick forward. In FIG. 15(A) the upper edge 42 of slot 24" serves as the stopper. In FIG. 15(C) projection 44 serves as the stopper. In FIG. 15(B) stepped surfaces 43 serve as the stopper. In FIG. 15(D) notches 45, 45' serve as the stopper. In FIG. 16(A) the stopper is formed as a projection 46 and in FIGS. 16(B), 16(C), 16(D), 16(E) and 16(F) the stopper is formed as a variety of notches or cut-outs 47–52.

When the contained medium is easily broken, such as a lip cream, it is convenient to extend the section wherein the two holding members are moved relative to each other. In an exceptional case the medium may forced forward entirely with such relative movement. In this case one or more stoppers are provided at the mid-point of slot 24 to restrict forward extension beyond the mid-point. Thus, the stopper may act at the mid-point of the relative movement between the two holding members, as shown in FIGS. 15(B) and 15(D).

The stopper means can be formed in other manners. The driven holding member 16 may be provided with a stopper projection, for instance, remote from the protrusion 19. And also a stopper projection may be provided on the following holding member 15, whereas the notch cooperating therewith would be provided on the driven holding member 16. Of course, the concave notch and the projection may be formed in a reverse manner. The stopper can be unlocked by means of the relative movement between the driven holding member 16 and the following holding member 15, or by the deformation of the concave portion and/or the projection. And also the stopper may be constructed in such a manner that the two holding members are attached or formed into one body.

The notch and the projection serving as a stopper may be configured to engage and disengage in a convenient manner. The notch may be semicircular, polygonal, elliptical, or other configuration. The projection (protrusion) may be a polygonal column such as a rectangle, hexagonal or octagonal column, semicircular column, elliptical column, double cylindrical column, cylindrical multi-column having a large and a small diameter portion, pipe type, spherical type, bending type, screw type, or other, configuration. In the case of a double cylindrical column or cylindrical multi-columns, the notch to be engaged therewith can be stepped.

Next several modified embodiments of the auxiliary stopper will be described.

Figure 17A:
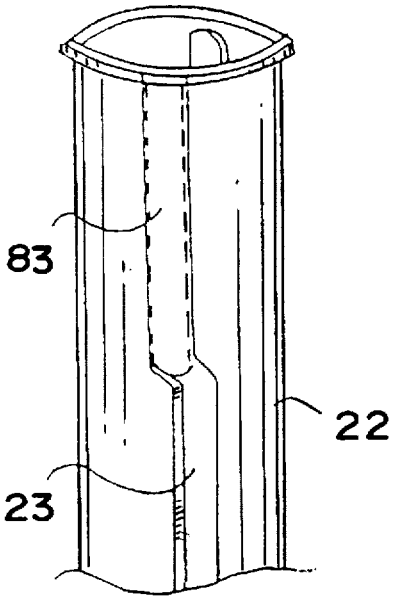
FIGS. 17(A)–17(D) show an embodiment of an auxiliary stopper.
Figure 17B:
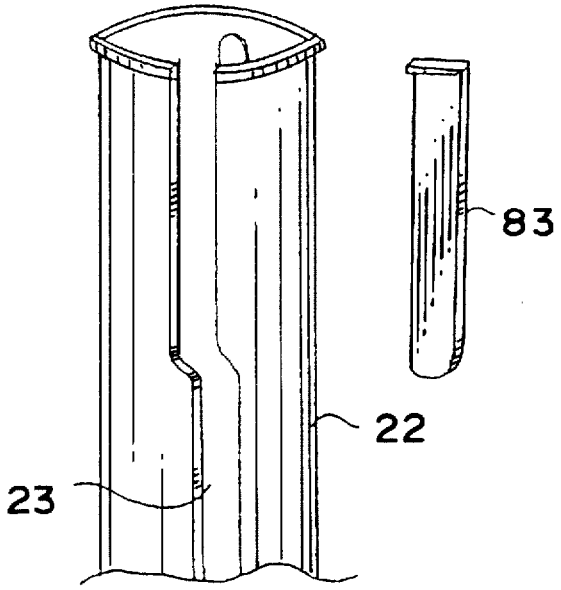

The auxiliary stopper shown in FIGS. 17(A) and 17(B) is a strip-shaped member 83, which is fixed in the upper portion 23*a* of the slot 23, filling it. The strip member 83 can be detached by being pulled or broken by the user. The strip member 83 may be provided with a tab at its top for easy removal. The driven holding member 16 is interrupted in its upward movement by means of the strip member 83 and, consequently, the two holding members are restricted from movement relative to each other.

Figure 17C:
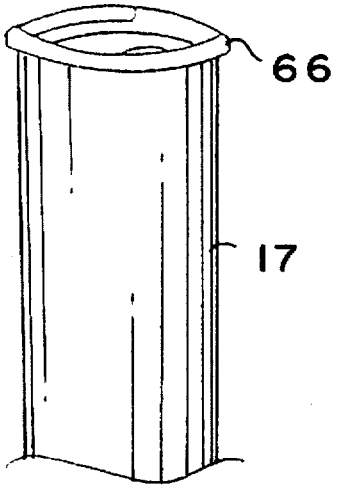
Figure 17D:
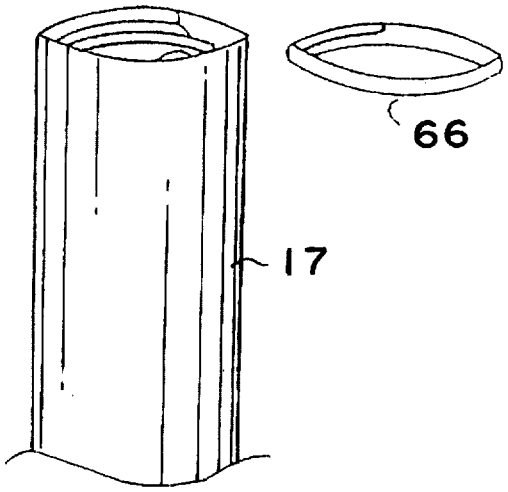

The auxiliary stopper shown in FIGS. 17(C) and 17(D) is constructed as an outside screw portion formed on the upper exterior of the cylindrical member 22, an interior screw portion formed on the upper interior of the rotation member 17, and a lid member 66 removably fixed on the cylindrical member 22. The screw portions of the two members are mated with each other, and the rotation member 17 is turned in the advance (reverse) rotation direction so that the rotation member 17 is moved slightly upward. When the rotation member 17 is turned in the advance direction, for example by one and a half rotations from the beginning, and immediately before the two holding members 15, 16 begin to move relative to each other, the top of the rotation member 17 comes into abutment with the lid member 66 so that it is restricted from further rotation. If the lid member 66 is removed, the rotation member 17 can be further turned in the advance direction so that the lipstick can be forced forward.

The lid member 66 may be so constructed as to be screwed into the cylindrical member 22 and to be moved gradually upward. In such case the lipstick is prevented from being forced excessively forward. The casing may be provided at its lower portion with a member corresponding to the lid member 66. In this case the screw is so formed that the rotation member is moved slightly downward when it is turned.

The exterior screw of the cylindrical member 22 may be formed as a helix screw, and provided with a movable auxiliary stopper member projecting therefrom at its midpoint. The rotation member 17 is restricted from moving in such a manner that the forward end of its interior screw thread is engaged by the projecting movable member. The movable member may be moved to a non-functional position by means of, for example, a switch located on the casing. In the alternative, the movable member may be moved to a non-functional position by the action of attaching the other member, whereby the auxiliary stopper is unlocked.

Figure 18A:
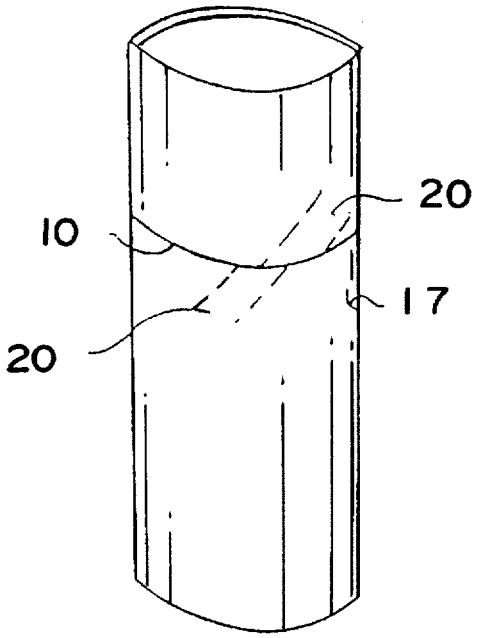
FIGS. 18(A) and 18(B) show a further embodiment of the auxiliary stopper.
Figure 18B:
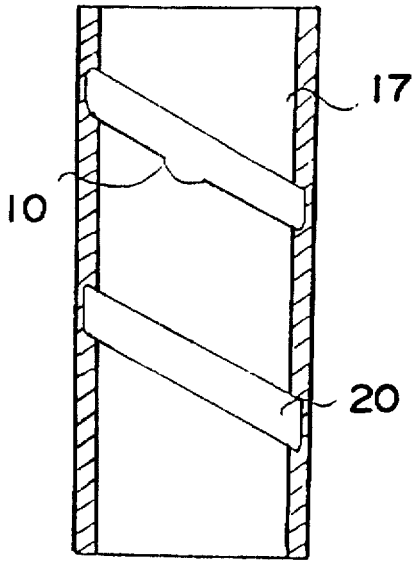

The auxiliary stopper may be formed by the rotation member 17 as shown in FIG. 18. The rotation member shown in FIG. 18(A) is formed of two divided bodies which can be rotated relative to each other. The two holding members can not be moved relative to each other except when the divided bodies are rotated so that the spiral channels are aligned. The rotation angle for aligning the two divided bodies may be a few degrees. The auxiliary stopper, shown in FIG. 18(B), is the concave notch 10 formed at the midpoint of the spiral channel 20.

Figures 19A, 19B, 19C:
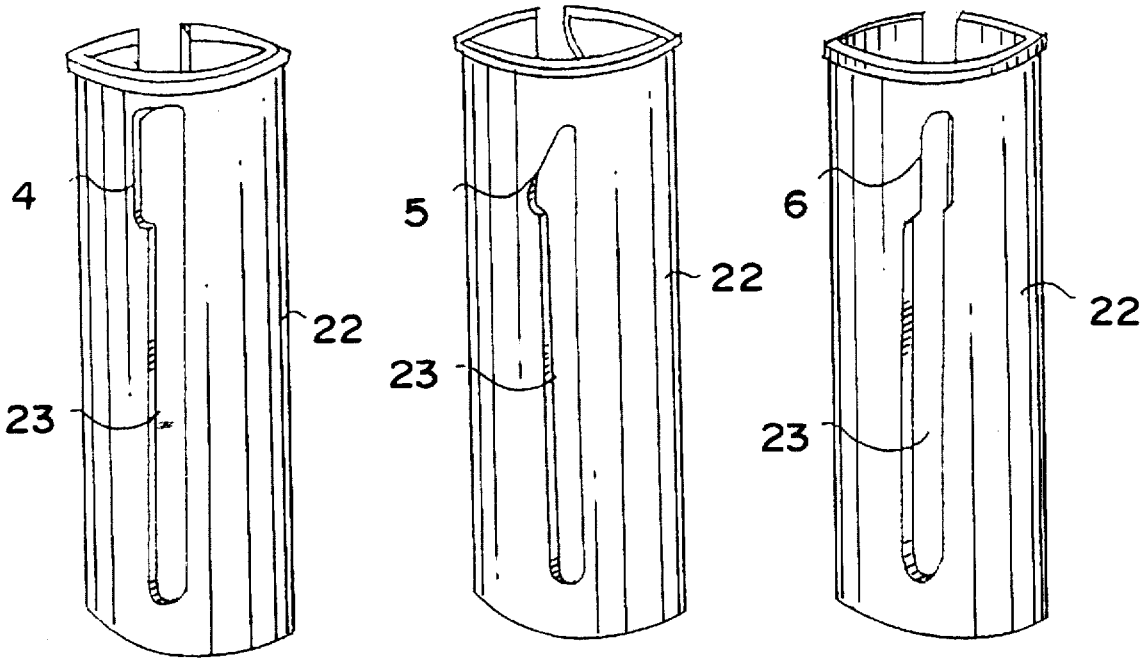
FIGS. 19(A)–19(C) are perspective views showing further embodiments of the auxiliary stopper.
Figures 20A, 20B, 20C:
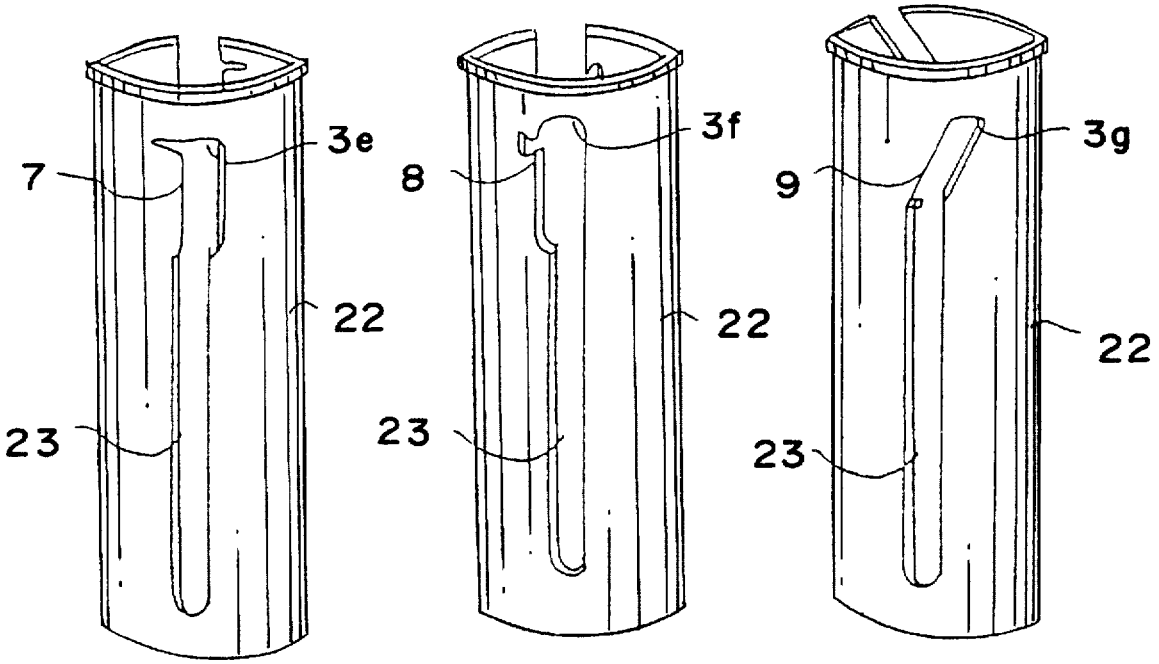
FIGS. 20(A)–20(C) are perspective views showing further embodiments of the auxiliary stopper.
Figure 21A:
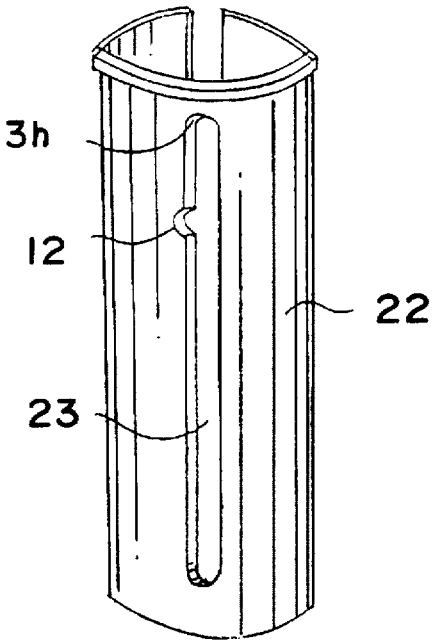
FIGS. 21(A) and 21(B) are perspective views of two additional embodiments of the auxiliary stopper.
Figure 21B:
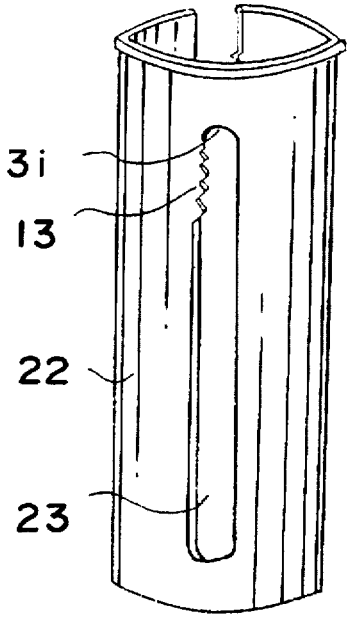

The cylindrical member 22 can be provided with various types of auxiliary stopper means 4–8 and 11–13 as shown in FIGS. 19–21 which show various concave notches, projections, steps and so forth employed as the auxiliary stopper member, in cooperation with the driven protrusion member 19. The auxiliary stopper can be a narrowing of the slot 23 of the cylindrical member 22 or a change in the angle of its slant at the midpoint of the slot. The cylindrical member 22 shown in FIG. 21(A) has a concave notch 12 at the left side top edge of the slot 23 which serves as an auxiliary stopper in cooperation with the projection formed at the top of the groove 24 of the following holding member 15 (see FIGS. 16(A), 16(B), 16(D), 16(F)).

Various modified embodiments of the interrupt means will now be described.

The interrupt means may be formed by a pulling interrupt member 99 as shown in FIGS. 22(A) and 22(B). The upper and the lower ends of the pulling interrupt member 99 are fixed, respectively, on the bottom of the following holding member 15 and the casing (or the cylindrical member). The pulling interrupt member 99 is loose in the retracted (non-use) position, whereas it is expanded when the following holding member 15 reaches the intermediate position so that it restricts the following holding member 15 from moving further upward. The following holding member 15 is provided with the stopper concave notch 60 at the left lower edge of the groove 24 (FIG. 3(B)). The lipstick holding member is driven by means of a screw member 90 which located on the central axis as shown in FIG. 22.

One of the spiral channels formed inside of the rotation member 17 may be relatively shorter as shown in FIG. 23(B), and its top 28 and the projection 25 of the following holding member 15 may serve as the interrupt means. Slot 23 of the cylindrical member 22 has a right angle turn at its middle. In this embodiment, the following holding member 15 is prevented from moving downward by means of the L-shaped slot when the lipstick is retracted, whereby the following holding member 15 begins to move downward together with the driven holding member 16. The stopper concave portion 60 is also provided in this embodiment.

On the other hand, the two holding members 15, 16 can be moved relative to each other in the axial direction in such a manner that the following holding member 15 is not completely stopped but is moved upward or downward. And the two holding members 15, 16 can be separately driven individually by driving means. In such case, the following holding member 16 is also provided with a driven protrusion which is driven by a spiral channel formed on the rotation member exclusively for (dedicated to) the following member. The rotation member is provided with two separate spiral channels. The two spiral channels and the guide slots of the cylindrical member are formed in such a manner that the two holding members are driven at first at the same speed and then, above the midpoint, at different speeds. The interrupt means (relative moving means) is provided in association with the drive system. The container having such a driving system may be provided with various types of stoppers and auxiliary stoppers in a suitable manner.

Other driving systems as described in Utility Model Second Published Nos. 5543100, 56-16969, 56-27845, 60-41847, 61-1089, 4-18497 can be employed. Such dispensing containers can be provided with various types of stoppers and auxiliary stoppers in a suitable manner.

Next an embodiment wherein the lipstick is forced forward by means of the deformation of a medium holding member 14 will be described with reference to FIGS. 24 and 25.

Figure 24A:
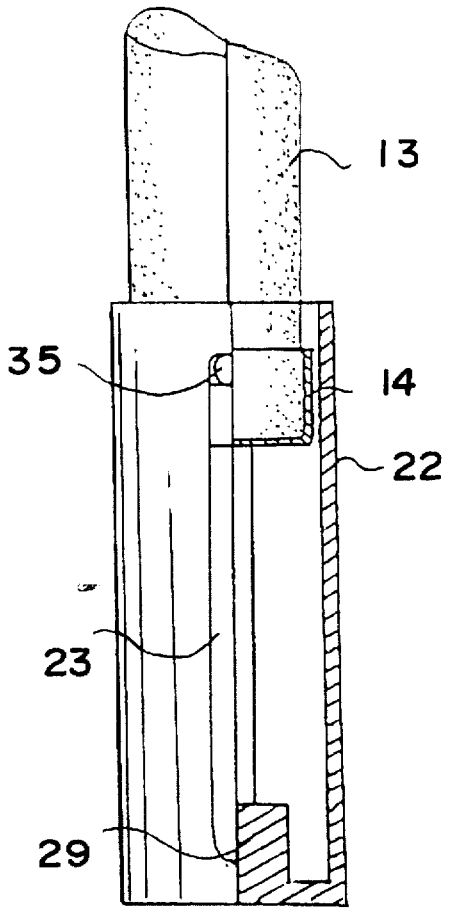
FIG. 24(A) is a perspective view of another embodiment of the invention before deformation.
Figure 24B:
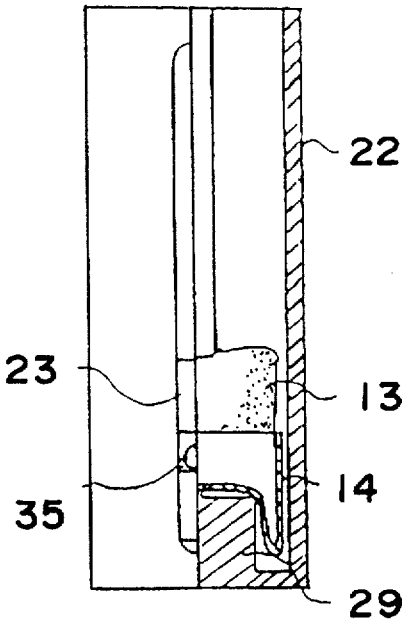
FIG. 24(B) is a perspective view of the same embodiment halfway through the deformation.
Figure 25A:
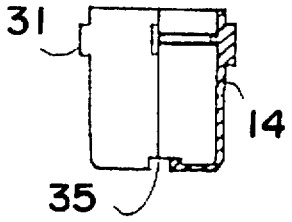
FIG. 25(A) is a sectional view of another embodiment of the invention showing a medium holding member.
Figure 25B:
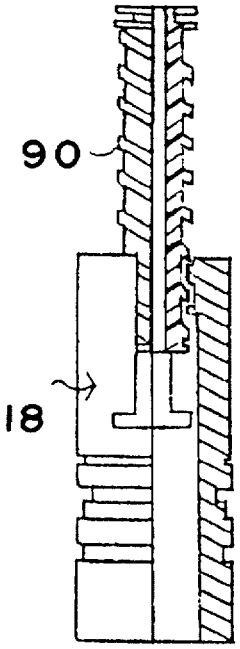
FIG. 25(B) is a sectional view of a driving means.
Figure 25C:
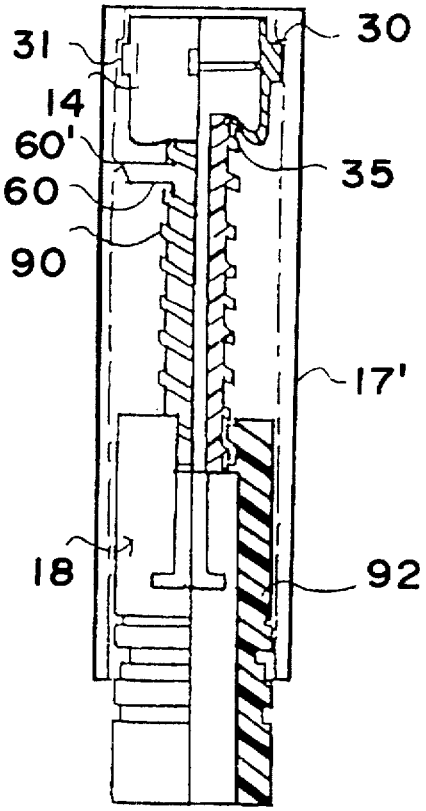
FIG. 25(C) is a sectional view showing the medium holding member beginning to be deformed.

In the embodiment of FIGS. 24 and 25, the cylindrical member 22 is provided at its bottom with a deformation means 29 for deforming the medium holding member 14. The medium holding member 14 is provided with a socket 35 which is directly driven by the drive means. The medium holding member 14 is substantially non-deformable by force of the stickiness of the medium, whereas it is deformable by a heavier force. Thus, the medium holding member 14 is not deformed in normal upward or downward movement. In this embodiment, the medium holding member 14 is formed of a synthetic rubber, a silicone rubber, a member of a rubber and a synthetic resin, or other composite material, and so forth. The medium holding member 14 may be in part conical or spherical, and may have a groove.

The socket 35 is driven downward with heavy force so that the medium holding member 14 is deformed as shown in FIG. 24(B), whereby the lipstick is forced forward from the holding member 14. The stopper is the force required to deform the medium holding member 14 in this embodiment. Stoppers and auxiliary stoppers as described above can be additionally employed.

In the embodiment shown in FIG. 25, the drive means for driving the medium holding member 14 is the combination of a screw member 90 and a cylindrical member 92 having a projection engaged therewith.

The screw member 90 and the cylindrical member 92 are attached to the bottom of the medium holding member 14 and to the casing 18, respectively, in detachable or fixed manner. The two members are arranged on the axis of the container. The medium holding member 14 is driven upward or downward by the relative rotation between the two members 90, 92. In this embodiment, the medium holding member 14 has a bottom 35 which receives the driving force from the top of the screw member 90.

The rotation member 17' and the medium holding member 14 are provided with projections 30, 31 at their respective tops, which act as the deformation means. The two deformation means or projections 30, 31 become engaged with each other when the medium holding member 14 comes to a predetermined position. The medium holding member 14 can be moved axially relative to the rotation member 17', whereas it can not be rotated relative thereto.

The lipstick is forced forward in the following manner. The casing 18 and the rotation member 17', or the two members 90, 92, are turned relative to each other until the two projections 30, 31 are engaged with one another. Thereafter, the two members 90, 92 are turned to each other with a heavy force so that the bottom of the holding member 14 is forced upward. Then the medium holding member 14 is deformed by a heavy external force exerted thereon and, consequently, the lipstick is forced forward.

An opposing force on the medium holding member 14 during its deformation also acts as the stopper in this embodiment, the other stopper being employed for restricting the deformation of the medium holding member 14. The stopper, for example, similar to the fifth embodiment, can be a resilient deformation member 64 attached to the upper portion of the screw member 90, in which case a step engaging member 60' is formed inside the rotation member 17' in cooperation with the former. The stopper can be also formed by the projection 64 and a narrowed portion of the groove formed on the rotation member 17'.

This invention is not restricted to the above mentioned embodiments. The driving means, for example, can be constructed in various other manners, and other members can be modified within the spirit of this invention. It is also important that they are so designed as to be assembled easily. And the medium container of this invention can be applied not only the lipstick but to other mediums as well.

I claim:

1. A dispensing container for a stick cosmetic comprising:

a cylindrical member having a longitudinally extending slot; holding means, slidably mounted in said cylindrical member for receiving and holding the stick cosmetic, said holding means comprising:

a first holding member axially movable relative to said cylindrical member between a fully retracted position and a fully extended position;

a second holding member, in the form of a cylinder slidably fitted with said first holding member, for axial movement relative to said first holding member;

stopper means for holding said first and second holding members together for movement in tandem between the fully retracted position and an intermediate position between the fully retracted position and the fully extended position;

interrupt means for preventing said second holding member from moving beyond said intermediate position toward said fully extended position; and driving means for moving said first and second holding members, held together by said stopper means, in tandem from the fully retracted position to the intermediate position, responsive to manual application of a first force, and for moving said first holding member beyond said intermediate position, toward said fully extended position, responsive to manual application of a second force greater than said first force and sufficient to release said stopper means.

2. A dispensing container according to claim 1 wherein said driving means comprises:

a rotatable sleeve fitted over said cylindrical member and having an interior cylindrical surface with a spiral channel formed therein;

wherein said second holding member has at least one longitudinally extending slot including extended and retracted slot portions offset relative to each other; and wherein said first holding member has at least one protrusion extending through the longitudinally extending slots of said cylindrical member and said second holding member and engaging said spiral channel of said rotatable sleeve, whereby said first holding member is driven between said extended and retracted positions as said first and second forces are generated by manual turning of said rotatable sleeve relative to said cylindrical member.

3. A dispensing container according to claim 2, wherein said interrupt means comprises a second slot formed in said cylindrical member and a radial projection formed on said second holding member, said radial projection being slidably engaged within said second slot, whereby said second holding member is prevented from moving from the intermediate position to the extended position by said radial projection abutting against a top edge of said second slot.

4. A dispensing container according to claim 3, wherein said second slot is generally parallel to said longitudinally extending slot of said second holding member.

5. A dispensing container according to claim 1, further comprising an axial projection extending from a closed end of said cylindrical member for engaging a closed end of the second holding member, upon retraction of said holding means, to release said stopper means.

6. A dispensing container according to claim 1, wherein:

said driving means comprises a rotatable sleeve, having first and second interior spiral channels, said second spiral channel being shorter than said first spiral channel; and wherein said second holding member has at least one longitudinally extending slot;

wherein said first holding member has at least one protrusion extending through the longitudinally extending slots of said cylindrical member and said second holding member and engaging said first spiral channel of said rotatable sleeve whereby said first holding member is driven between said extended and retracted positions as said first and second forces are generated by manual turning of said rotatable sleeve relative to said cylindrical member; and wherein said interrupt means comprises a radial projection formed on said second holding member and engaged within said second spiral channel.

7. A dispensing container according to claim 6 wherein said longitudinally extending slot of said cylindrical member is L-shaped with a longitudinal portion and a circumferential portion.

8. A dispensing container according to claim 1, further comprising a base supporting said cylindrical member and an axial projection extending from said base, the stick cosmetic being forced forward from the holding means by said axial projection responsive to movement of the first holding member to said retracted position by said driving means.

9. A dispensing container according to claim 1, wherein said interrupt means comprises a flexible member having one end connected to said second holding member and an opposite end connected to a base portion fixed at one end of said cylindrical member.

10. A dispensing container according to claim 1, wherein one end of said second holding member extends beyond an open end of said cylindrical member when said second holding member is stopped by said interrupt means.

11. A dispensing container according to claim 1, further comprising anti slip-off means for preventing said second holding member from disengaging completely from said first holding member while allowing telescoping relative movement therebetween.

12. A dispensing container according to claim 1, further comprising auxiliary stopper means for restricting the movement of the first holding member relative to said second holding member in movement from the intermediate position to the extended position.

13. A dispensing container according to claim 1, wherein said first holding member is directly engaged and driven by said driving means and said second holding member is driven by said first holding member.

14. A dispensing container for a stick cosmetic relative to a casing between extended and retracted positions and comprising:

a holding member, slidably mounted in said casing responsive to a first manually applied force, for holding the stick cosmetic, said holding member including a deformable portion which maintains structural integrity against said first force; and deforming means, fixed to the casing, for engaging said deformable portion as the holding member is moved to the retracted position and for simultaneously deforming said deformable portion responsive to a second manually applied force greater than said first force, thereby forcing the stick cosmetic to slide relative to the holding member, thereby further extending the stick cosmetic when moved to the extended position.

15. A dispensing container according to claim 14, further comprising stopper means for engaging to limit the extent of deformation of the deformable portion and for releasing to allow further deformation of said deformable portion.

* * * * *